US008418283B2

(12) United States Patent
Serhan et al.

(10) Patent No.: US 8,418,283 B2
(45) Date of Patent: Apr. 16, 2013

(54) UNIVERSAL BED SYSTEM

(75) Inventors: Michael Serhan, Acadia, CA (US); Harvey Diamond, Armonk, NY (US)

(73) Assignee: Drive Medical Design & Mfg., Port Washington, NY (US)

( * ) Notice: Subject to any disclaimer, the term of this patent is extended or adjusted under 35 U.S.C. 154(b) by 7 days.

(21) Appl. No.: 13/103,573

(22) Filed: May 9, 2011

(65) Prior Publication Data

US 2011/0271443 A1 Nov. 10, 2011

Related U.S. Application Data

(60) Provisional application No. 61/333,096, filed on May 10, 2010.

(51) Int. Cl.
*A47C 31/00* (2006.01)

(52) U.S. Cl.
USPC ..... 5/11; 5/610; 5/611

(58) Field of Classification Search ..... 5/11, 611, 5/610, 600, 183; 108/20, 147
See application file for complete search history.

(56) References Cited

U.S. PATENT DOCUMENTS

| | | | | |
|---|---|---|---|---|
| 2,522,759 | A * | 9/1950 | Lindquist | 5/610 |
| 3,015,113 | A * | 1/1962 | Wallen | 5/11 |
| 3,045,256 | A * | 7/1962 | Scher | 5/11 |
| 3,105,246 | A | 10/1963 | Emrick | |
| 3,919,727 | A | 11/1975 | Paine | |
| 4,324,010 | A | 4/1982 | Houlberg et al. | |
| 4,846,011 | A | 7/1989 | Gaffney | |
| 5,134,731 | A | 8/1992 | Quintile et al. | |
| 5,544,375 | A | 8/1996 | Urness et al. | |
| 5,685,035 | A | 11/1997 | Urness et al. | |
| 5,713,091 | A | 2/1998 | Houchin | |
| 5,802,639 | A | 9/1998 | Raasch et al. | |
| 5,964,347 | A | 10/1999 | Urness | |
| 6,000,077 | A | 12/1999 | Cyr | |
| 6,678,907 | B1 | 1/2004 | Voelker et al. | |
| 6,779,210 | B1 | 8/2004 | Kelly | |
| 6,983,495 | B2 * | 1/2006 | Snyder et al. | 5/11 |
| 6,997,082 | B2 * | 2/2006 | Snyder et al. | 74/606 R |
| 7,302,716 | B2 | 12/2007 | Snyder et al. | |
| 7,441,289 | B2 * | 10/2008 | Loewenthal | 5/611 |
| 2006/0053550 | A1 * | 3/2006 | Snyder et al. | 5/11 |
| 2007/0080030 | A1 | 4/2007 | Kramer | |
| 2009/0094747 | A1 | 4/2009 | Bly et al. | |
| 2009/0100598 | A1 | 4/2009 | Bly et al. | |

* cited by examiner

*Primary Examiner* — Robert G Santos
*Assistant Examiner* — Richard G Davis
(74) *Attorney, Agent, or Firm* — Carter, DeLuca, Farrell & Schmidt, LLP

(57) ABSTRACT

The present disclosure relates to an adjustable bed system including a bed frame that is adjustable in height. In one aspect of the present disclosure, the adjustable bed system includes first and second end boards each having an independent height adjustment mechanism. A frame assembly configured and dimensioned to be secured to the first end board at a first end thereof and to the second end board at a second end thereof includes a frame and a transition box. The transition box is secured to the frame at the first end thereof and is operatively engagable with the height adjustment mechanism of the first end board. A drive shaft adjustable between first and second lengths is coupled at a first end thereof to the transition box and at a second end thereof to the second end board to facilitate uniform height adjustment of the first and second end boards.

18 Claims, 17 Drawing Sheets

UNIVERSAL BED SYSTEM

CROSS-REFERENCE TO RELATED APPLICATION

The present application claims priority to, and benefit of, U.S. Provisional Patent Application No. 61/333,096 entitled "Universal Bed System" filed on May 10, 2010, the entire contents of which are hereby incorporated by reference herein.

BACKGROUND

1. Technical Field

The present disclosure relates to an adjustable bed system, and more particularly, to an adjustable bed system with a bed frame that is adjustable in height.

2. Background of Related Art

Adjustable beds are often used in both home care, and in more formalized medical settings, e.g., hospital rooms. Adjustable beds generally include a pair of end boards, i.e., a headboard and a footboard, a bed frame that extends between the end boards to support a mattress, and a mechanism that allows the height of the bed frame to be adjusted between the end boards so that the bed frame, and thus the mattress and patient, can be raised and lowered.

Various height adjustment mechanisms are known in the art, and typically include a pair of transition boxes, or gearboxes, that are positioned on the end boards, i.e., one transition box on the footboard, and another transition box on the headboard. The transition boxes include internal gearing mechanisms, and are connected to drive screws extending vertically through the end boards such that upon actuation of the transition boxes, the drive screws rotate to either raise or lower the bed frame dependent upon the direction of rotation. One example of such an arrangement is described in U.S. Pat. No. 5,134,731 (hereinafter "the '731 patent").

Adjustable bed systems can be either manually operated, or automatic. Manual systems utilize transition boxes that are operated via a hand crank, for example, whereas automated systems regulate operation of the transition boxes via an electric motor. In both manual and automated systems known in the art, the transition boxes are arranged on the end boards so that they face each other when the system is assembled. A drive shaft extends between, and connects, the transition boxes so that the actuation of one transition box causes corresponding actuation of the other. More specifically, since the drive shaft is connected to both the transition boxes, actuating one of the transition boxes causes rotation of the drive shaft, which thereby transmits a rotational force to the other transition box to the cause simultaneous actuation.

In adjustable bed systems such as that described in the '731 patent, the end boards are different, in that the transition boxes included on the headboard and the footboard are configured for rotation in opposite directions during use. However, such systems have led to inefficiencies during delivery and assembly. For example, on the occasion that two headboards or two footboards are inadvertently delivered, as opposed to one headboard and one footboard, the system would not function properly upon assembly, if at all. In order to remedy the predicament, the bed system would have to be disassembled, and the appropriate parts, i.e., either the missing headboard or footboard, would have to be re-delivered, resulting in not only increased operational costs, but customer dissatisfaction as well.

Systems such as those described in U.S. Pat. Nos. 6,983,495, 6,997,082, 7,302,716, and 7,441,289 have attempted to prevent such delivery and assembly issues via the development of identical headboards and footboards. Utilizing identical headboards and footboards reduces manufacturing costs, while also eliminating the chance for delivery of an improper end board. These systems, however, are incompatible with systems such as those described in the '731 patent.

Accordingly, the present disclosure is directed to an improved adjustable bed system, and in particular, to an improved bed frame, that is universal in the sense that it can be used with different end boards, such as those described in the '731 patent, as well as with identical end boards, such as those described in U.S. Pat. Nos. 6,983,495, 6,997,082, 7,302,716, and 7,441,289.

SUMMARY

In one aspect of the present disclosure, an adjustable bed system is disclosed that includes first and second end boards, which may be either identical or different in structure and operation, each having an independent height adjustment mechanism therein. The presently disclosed bed system also includes a frame assembly having a frame that is configured and dimensioned to be secured to the first and second end boards. More particularly, the frame assembly is configured and dimensioned to be secured to the first end board at a first end thereof. and to the second end board at a second end thereof. The frame assembly includes a frame, and a transition box secured to the frame at the first end thereof. The transition box is operatively engagable with the height adjustment mechanism of the first end board. A drive shaft defining an adjustable length is coupled at a first end thereof to the transition box and at a second end thereof to the second end board. The drive shaft is operable to facilitate uniform height adjustment of the first and second end boards.

In one embodiment, the drive shaft includes a center portion, and a plurality of outer portions extending from the center portion. The center portion and the outer portions are connected in telescoping arrangement to facilitate selective variation of the length of the drive shaft.

In another embodiment, the transition box includes a housing having first and second inputs at one end thereof. Each input has a gear selectively couplable to the first end of the drive shaft. The gears disposed in meshed engagement with one another. The transition box further includes a rod extending outwardly from the other end thereof that is coupled to the gear of the first input and is engaged to the height adjustment mechanism of the first end board.

In yet another embodiment, the transition box includes markings on an outer periphery of the housing and adjacent to one or both of the first and second inputs to distinguish the first and second inputs from one another.

In still another embodiment, the gears of the first and second inputs are disposed in vertical registration relative to one another.

In still yet another embodiment, the first and second end boards are identical in structure. In such an embodiment, the drive shaft is coupled to the gear of the second input of the transition box such that the rod and the drive shaft are rotatable in opposite directions to effect uniform height adjustment of the first and second end boards. Alternatively, the bed system may be configured for use with different end boards. In this embodiment, the drive shaft is coupled to the gear of the first input of the transition box such that the rod and the drive shaft are rotatable in similar directions to effect uniform height adjustment of the first and second end boards.

In another embodiment, the length of the drive shaft is adjusted to accommodate usage of various different end boards with the frame assembly and/or to accommodate engaging the drive shaft within a plurality of inputs of the transition box.

In yet another embodiment, the bed system further includes a bracket member engaged to the frame and extending from an underside thereof. The bracket member is configured and dimensioned to receive the drive shaft at least partially therethrough to inhibit relative movement between the drive shaft and the frame.

In still another embodiment, one or more components of the frame assembly are color-coded to help identify an attachment position on the frame, e.g., for attaching a side rail thereto.

In accordance with another embodiment of the present disclosure, a frame assembly for use in an adjustable bed system including a first end board with a first height adjustment mechanism therein and a second end board with a second height adjustment mechanism therein is provided. The frame assembly includes a frame, a drive shaft and a bracket member. The drive shaft extends along a length of the frame and is coupled to the height adjustment mechanisms of the first and second end boards. The drive shaft is operable to facilitate uniform height adjustment of the first and second end boards. The bracket member is engaged to the frame on an underside thereof and defines one or more openings therethrough that are configured and dimensioned to at least partially receive the drive shaft therethrough to inhibit relative movement between the drive shaft and the frame.

In one embodiment, the frame assembly further includes a ring member including an opening extending therethrough configured and dimensioned to receive the drive shaft. The ring member defines an outer dimension larger than an inner dimension of the one or more openings of the bracket member such that the ring member is prevented from passing through the opening(s) in the bracket member to help inhibit relative movement between the drive shaft and the frame. The ring member may further include a screw member that is repositionable relative to the ring member to vary the opening extending through the ring member, thereby selectively inhibiting relative movement between the drive shaft and the ring member.

In another embodiment, the bracket member includes a first end with a first side opening defining an inner dimension, and a second end with a second side opening defining an inner dimension. The first and second side openings are configured and dimensioned to permit passage of the drive shaft therethrough.

In yet another embodiment, the bracket member includes a plate having a pair of wings extending therefrom for engaging the bracket member to the frame. The plate includes an opening defined therethrough that is configured and dimensioned to permit passage of the drive shaft therethrough.

In still another embodiment, the drive shaft defines an adjustable length such that the drive shaft may be selectively adjustable between a first length and a second length for coupling to various different types of end boards and/or coupling to the first and second end boards in different positions.

In still yet another embodiment, one or more components of the frame assembly are color-coded to identify an attachment position on the frame, e.g., for attachment of side rails thereto.

These and other features of the presently disclosed subject matter will become more readily apparent to those skilled in the art through reference to the detailed description of the various embodiments provided below, and the accompanying drawings.

BRIEF DESCRIPTION OF THE DRAWINGS

Various embodiments of the presently disclosed adjustable bed system, frame assembly, and components thereof will be described herein below with reference to the accompanying drawings, wherein.

DESCRIPTION OF VARIOUS EMBODIMENTS

Various exemplary embodiments of the presently disclosed subject matter will now be described in detail with reference to the drawings, wherein like references characters identify similar or identical elements.

Figure 1:
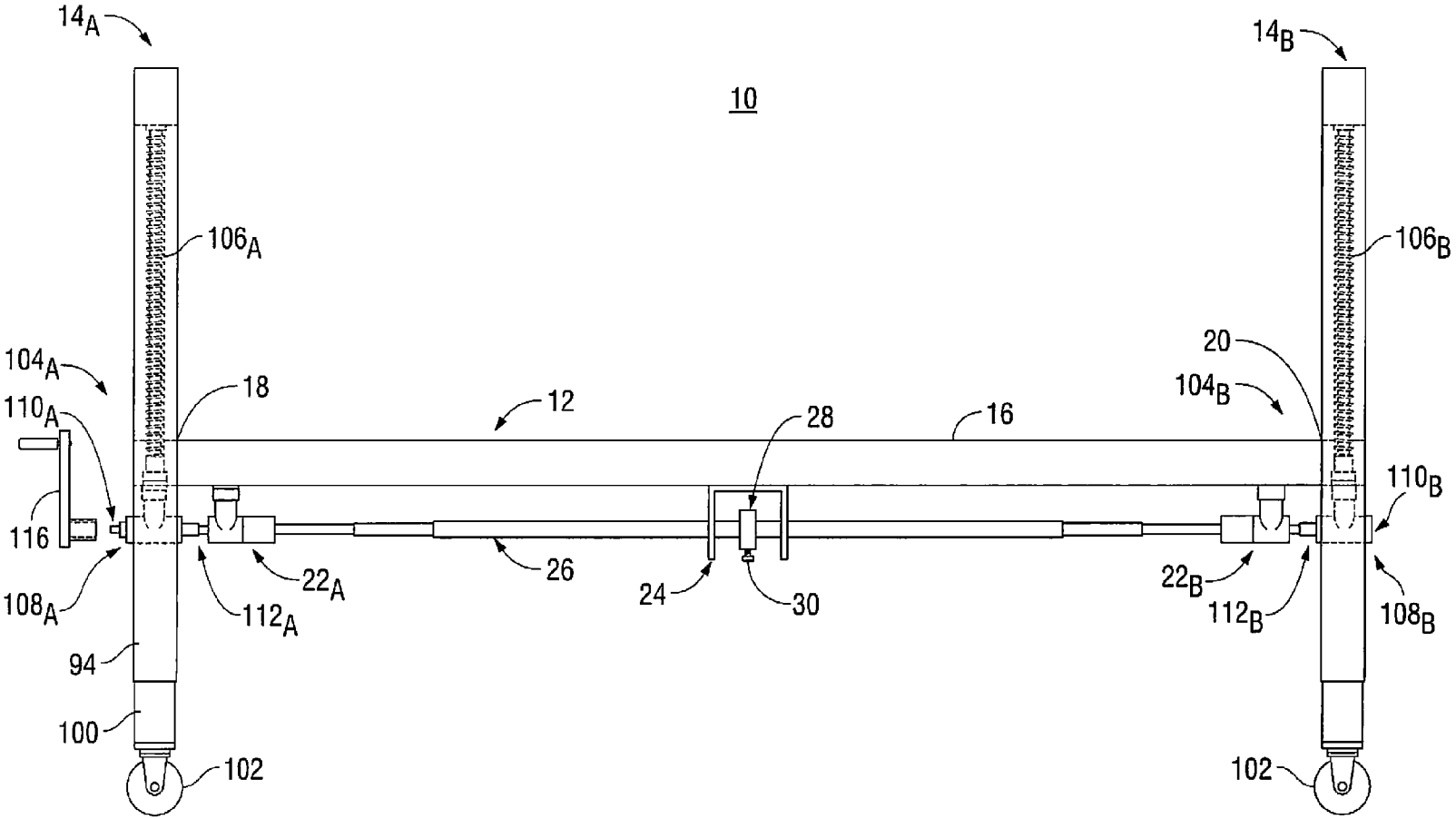
FIG. 1 is a side view of an adjustable bed system according to the principles of the present disclosure that includes a pair of end boards, and a frame assembly.
Figure 2:
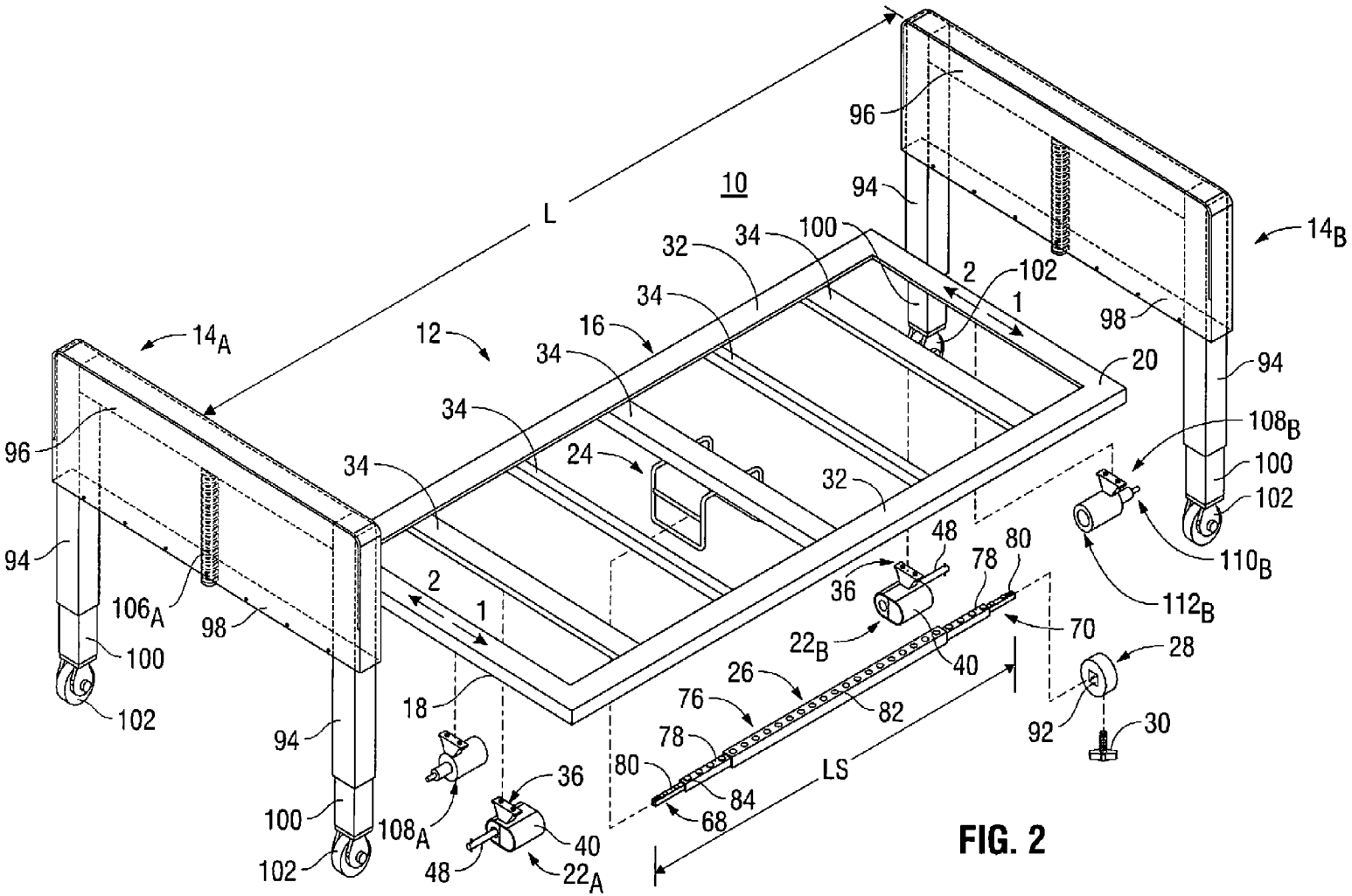
FIG. 2 is a top, perspective view of the presently disclosed bed system with parts separated.

FIGS. 1 and 2 illustrate one embodiment of a universal, adjustable bed system 10 according to the principles of the present disclosure. The bed system 10 will find application in not only a hospital setting, but in private home care settings as well. The bed system 10 includes a frame assembly 12, and a pair of end boards $\mathbf{14}_A$, $\mathbf{14}_B$ that are secured to opposite ends of the frame assembly 12. The bed system 10 is adjustable in the sense that the height of the bed system 10, and more particularly, the height of the frame assembly 12, can be uniformly varied across the length "L" (FIG. 2) of the frame assembly 12. Throughout the present disclosure, the term "height" should be understood as referring to the vertical position of a particular component of the presently disclosed bed system 10, i.e., to the vertical distance between a particular component, and the surface on which the bed system 10 stands.

The frame assembly 12 includes a frame 16 with respective first and second ends 18, 20, first and second transition boxes, which are respectively identified by the reference characters $\mathbf{22}_A$ and $\mathbf{22}_B$, a bracket member, or cage structure 24, a drive shaft 26, a ring member 28, and a screw member 30. In other embodiments, as will be described below with reference to FIGS. 15-16, bed system 200 may be configured for use with only one transition box 222.

The first end 18 of the frame 16 is secured to the end board $\mathbf{14}_A$, and the second end 20 of the frame 16 is secured to the end board $\mathbf{14}_B$. Throughout the present disclosure, the frame 16 will be described as being releasably secured to the end boards $\mathbf{14}_A$, $\mathbf{14}_B$. It is envisioned that the releasable connection between the frame 16 and the end boards $\mathbf{14}_A$, $\mathbf{14}_B$ may be established through the employ of any suitable means, e.g., via a plurality of brackets, screws, pins, or the like. However, it should be appreciated that, in alternative embodiments of the present disclosure, the frame 16 may be fixed to the end boards $\mathbf{14}_A$, $\mathbf{14}_B$, e.g., via a series of welds, without departing from the scope of the preset disclosure.

The frame 16 is formed from a plurality of interconnected strut members 32 (FIG. 2) and cross members 34, and is configured and dimensioned to support a mattress (not shown), or other such structure. As is conventional and known in the art, it is envisioned that the strut members 32 and the cross members 34 may be connected to allow for adjustments in the configuration of the frame 16. For example, it is envisioned that the strut members 32 may include sections that are pivotably connected together to allow the height of the respective first and second ends 18, 20 of the frame 16 to be increased or decreased, to thereby elevate or lower a patient's head and/or feet. It is further envisioned that the configuration of the frame 16 may be adjusted either manually or automatically, e.g., through the employ of a motor. In some embodiments, as will be described in detail below, the frame may include a resilient metallic mesh 300 (FIGS. 17-18) disposed thereon to support to the matters (not shown).

Figure 15:
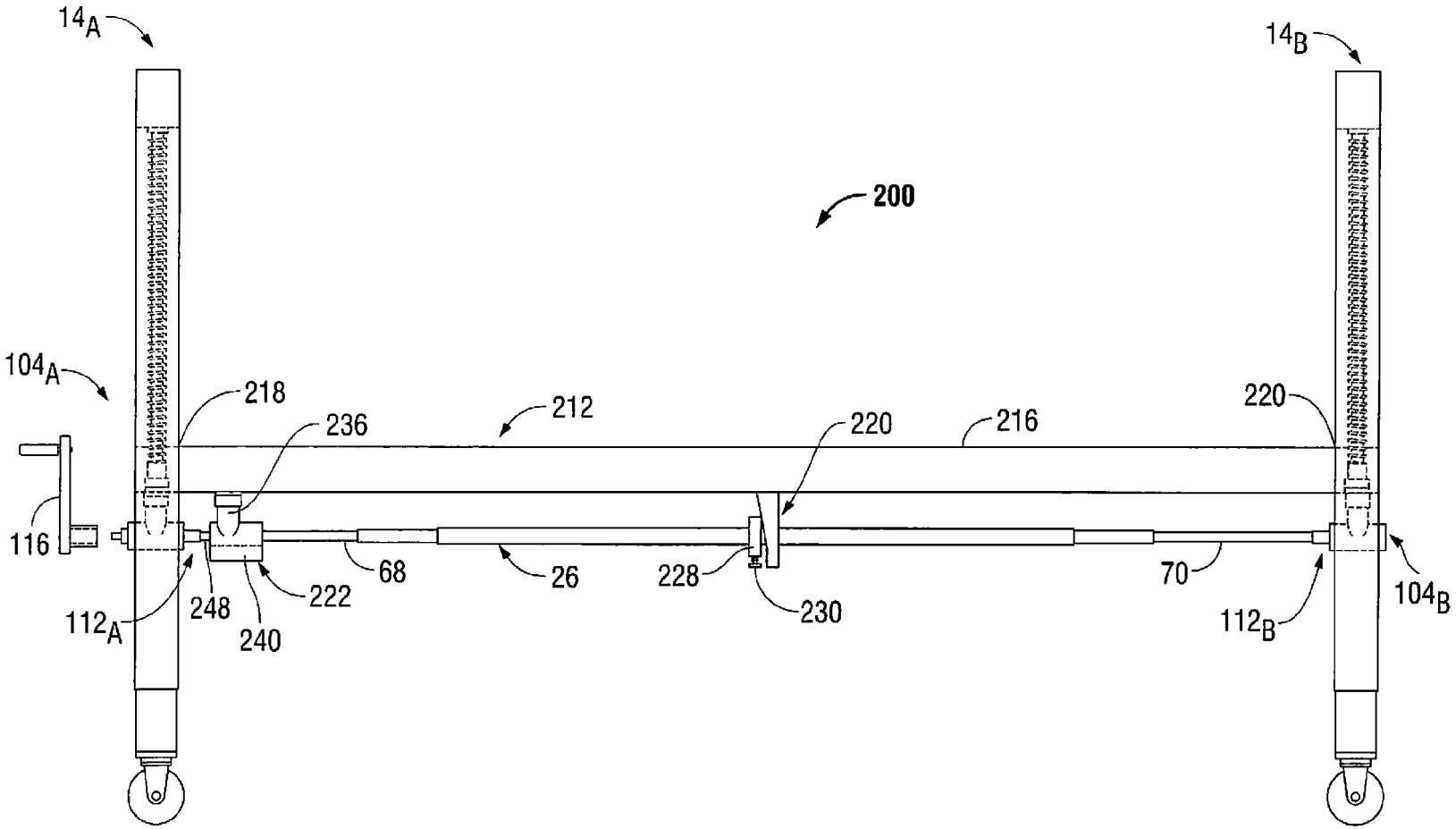
FIG. 15 is a side view of another embodiment of an adjustable bed system according to the present disclosure.
Figure 16:
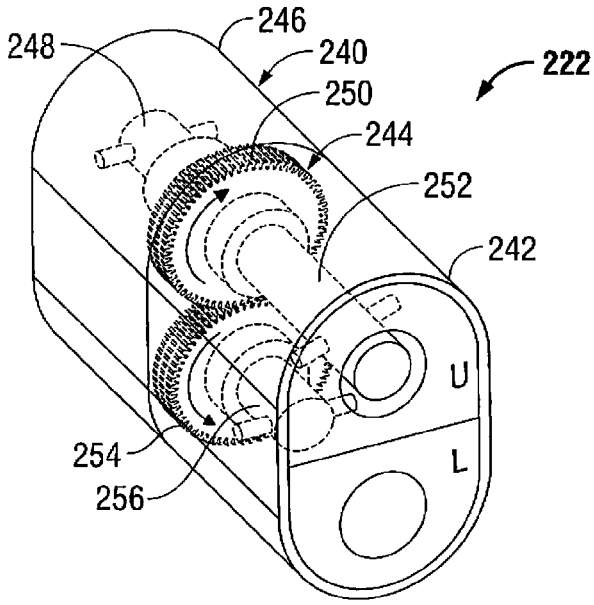
FIG. 16 is an end, perspective view of the transition box of the adjustable bed system of FIG. 15.

With reference now to FIGS. 1-5, the transition boxes $\mathbf{22}_A$, $\mathbf{22}_B$ will be described. The internal structure, external structure, and operation of the transition box $\mathbf{22}_A$ is identical to that of the transition box $\mathbf{22}_B$. Accordingly, while the transition boxes $\mathbf{22}_A$, $\mathbf{22}_B$ are illustrated separated in FIGS. 3 and 5, respectively, in the interests of brevity, only the transition box $\mathbf{22}_A$ will be described herein below. Embodiments wherein only a single transition box 222 (FIGS. 15-16) is provided will be described below, although many of the features of transition boxes $\mathbf{22}_A$, $\mathbf{22}_B$ apply similarly to transition box 222 (FIGS. 15-16).

The transition box $\mathbf{22}_A$ includes a mounting structure 36 that facilitates connection of the transition box $\mathbf{22}_A$ to the frame 16, e.g., adjacent the first end 18 (FIGS. 1, 2). While the transition box $\mathbf{22}_A$ is illustrated as being secured to a cross-member 34 in FIGS. 1 and 2, the transition box $\mathbf{22}_A$ may be secured to the frame 16 in any suitable location.

It is envisioned that the mounting structure 36 may secure the transition box $\mathbf{22}_A$ to the frame 16 in a manner that would allow for multidimensional adjustments in the position of the transition box $\mathbf{22}_A$. For example, in the embodiment of the frame assembly 12 seen in FIGS. 1-5, the mounting structure 36 is illustrated as including a plurality of bolts 38 to secure the transition box $\mathbf{22}_A$ to the frame 16. In this embodiment, it is contemplated that the frame 16 may include a plurality of openings (not shown) that are each configured and dimensioned to receive the bolts 38, whereby the horizontal position of the transition box $\mathbf{22}_A$ can be adjusted, i.e., in the directions indicated by arrows 1 and 2 in FIG. 2, by varying the openings into which the bolts 38 are inserted. It is further envisioned that by tightening and loosening the bolts 38, the height of the transition box $\mathbf{22}_A$, i.e., the distance between the transition box $\mathbf{22}_A$ and the floor, could also be adjusted. It should be appreciated, however, that in alternative embodiments, the mounting structure 36 may be configured and dimensioned to secure the transition box $\mathbf{22}_A$ to the frame in another manner facilitating adjustment in the aforedescribed manner. Additionally, and in the alternative, it is envisioned that the mounting structure 36 may be configured and dimensioned to fixedly connect the transition box $\mathbf{22}_A$ to the frame 16 to substantially inhibit, if not completely prevent, relative movement between the transition box $\mathbf{22}_A$ and the frame 16. For example, the mounting structure 36 may be secured to the frame 16 via a series of welds (not shown).

The transition box $\mathbf{22}_A$ further includes a housing 40 that accommodates the internal components thereof. The housing 40 includes a first end 42 (FIG. 3) with an internal gear assembly 44, and a second end 46 with a transmission rod 48 that extends outwardly therefrom.

Figure 3:
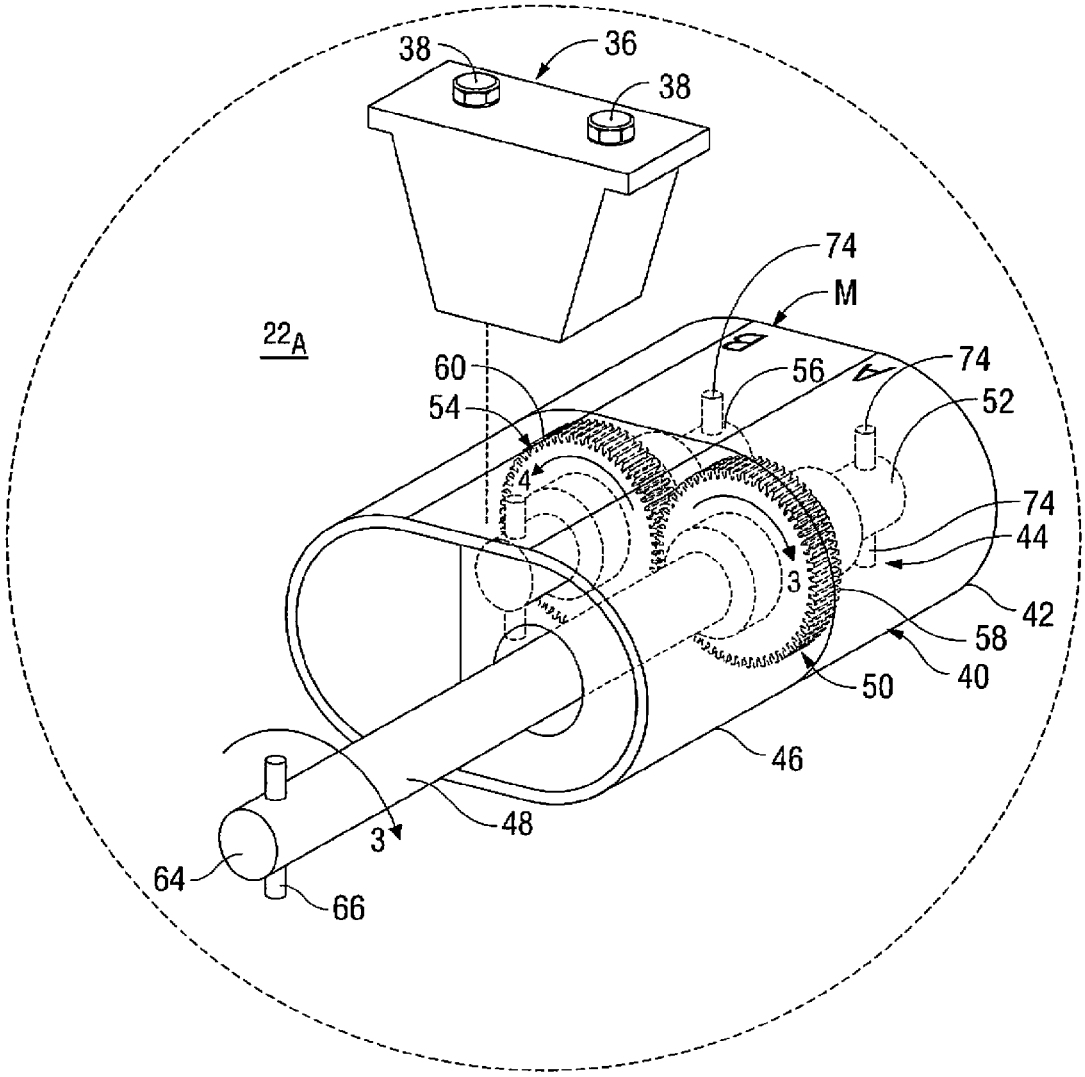
FIG. 3 is an end view of a transition box component of the presently disclosed frame assembly.

The internal gear assembly 44 includes a first gear 50 that is supported on a first shaft 52, and a second gear 54 that is supported on a second shaft 56. As best seen in FIG. 3, the respective first and second gears 50, 54 are positioned in side-by-side, horizontal relation. Stated differently, the first shaft 52 and the first gear 50 are positioned the same distance from the frame 16 as the second shaft 56 and the second gear 54. Alternatively, as shown in FIGS. 15-16, first and second gears 250, 254, respectively, may be positioned in vertical alignment with one another.

The first and second gears 50, 54 respectively include teeth 58, 60 (FIGS. 3, 5) that are configured and dimensioned to facilitate mating engagement of the gears 50, 54, whereby rotation of one of the gears 50, 54 causes corresponding rotation of the other, but in opposing directions. For example, with respect to FIG. 3, rotation of the gear 50 in the direction indicated by arrow 3 will cause rotation of the gear 54 in the direction indicated by arrow 4.

To facilitate identification and differentiation between the gears 50, 54 and the shafts 52, 56, the housing 40 may optionally include visual markers M on an outer surface thereof. In the embodiment of the transition box $\mathbf{22}_A$ illustrated in FIG. 3, for instance, the first gear 50 and first shaft 52 are identified by an "A," and the second gear 54 and second shaft 56 are identified by the letter "B." However, these visual makers M may include color-coding, letters, numbers, brief phrasing, symbols, or any other suitable marker that facilitates identification of a particular gear, or shaft of the transition box $\mathbf{22}_A$. Further, the visual markers M may be formed directly on the outer surface of housing 40, or may be adhered, or otherwise disposed thereon, e.g., as stickers (not shown).

Figure 4:
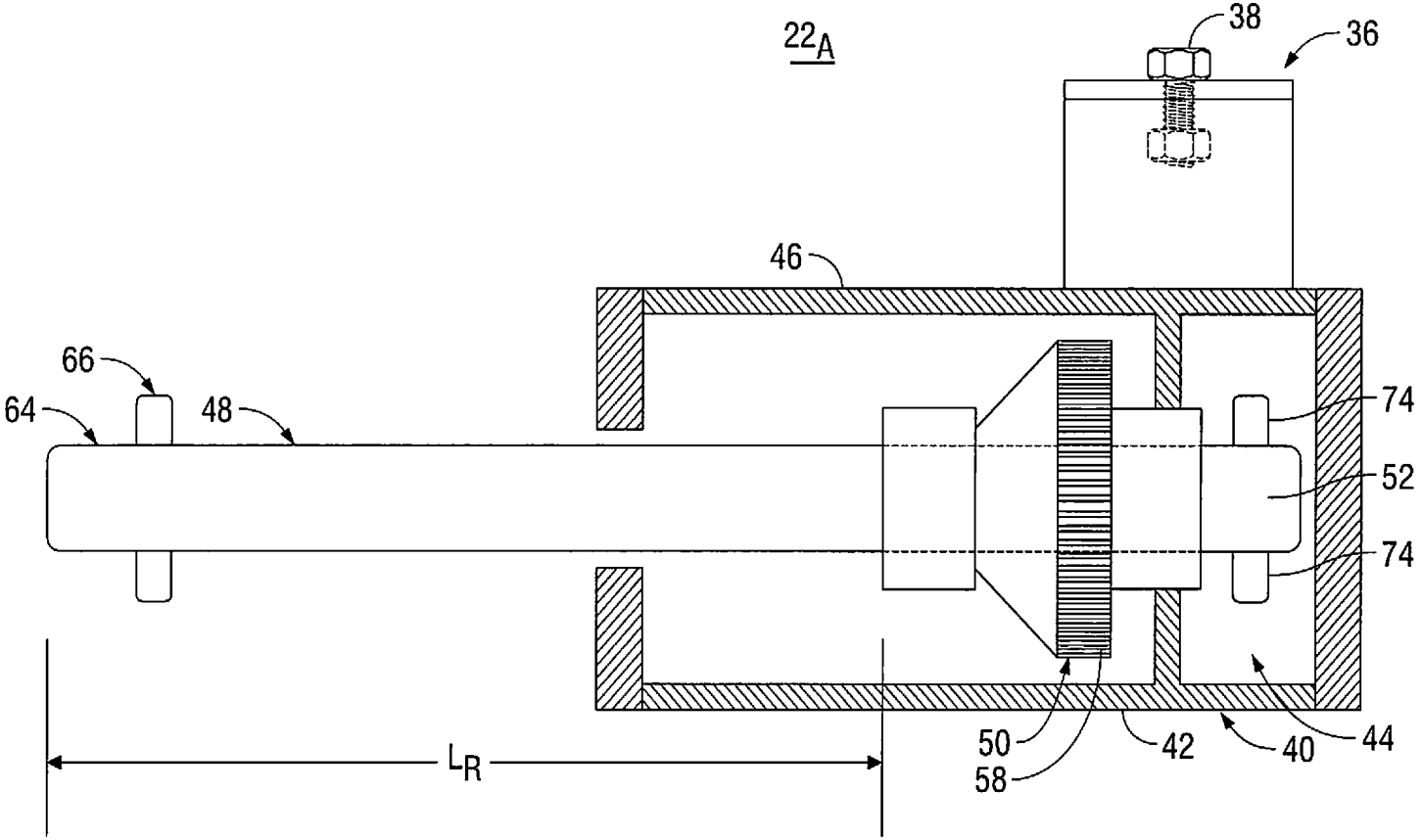
FIG. 4 is a side, schematic view of the transition box shown in FIG. 3.
Figure 5:
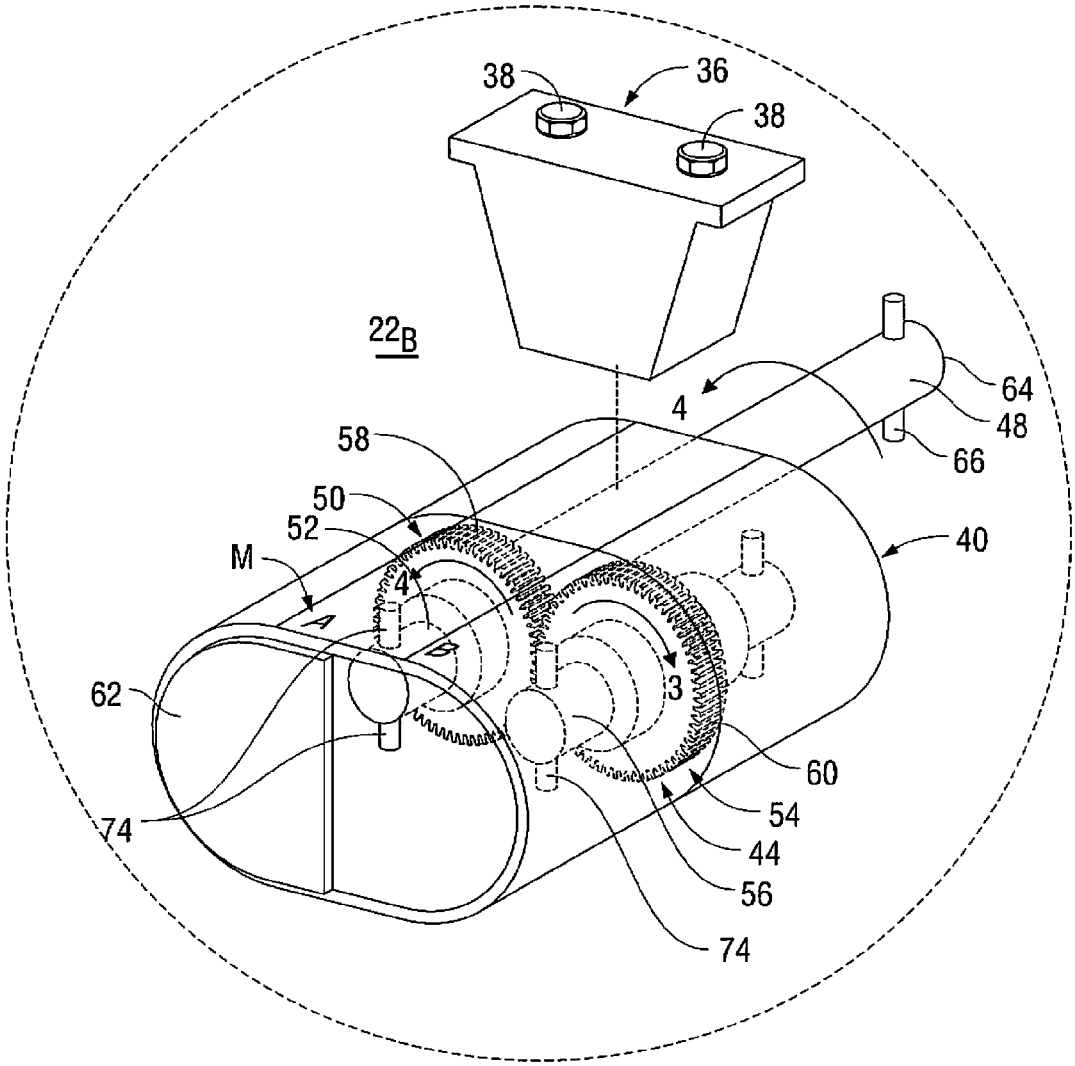
FIG. 5 is an end, perspective view of the transition box shown in FIG. 3.

In the embodiment of the disclosure illustrated in FIGS. 1-5, the housing 40 further includes a door 62 (FIG. 5). The door 62 is configured and dimensioned to selectively obscure, and selectively reveal, either the first gear 50 or the second gear 54 for reasons that will be discussed below. In alternative embodiments, however, it is also envisioned that the door 62 may be configured and dimensioned to selectively obscure and reveal the respective first and second gears 50, 54 simultaneously.

The transmission rod 48 extends away from the housing 40, and is connected to the either the first shaft 52, as illustrated in FIGS. 3 and 4, or the second shaft 56, either directly, or via a series of mechanical engagements. Due to the mechanical connection of the transmission rod 48 to the first shaft 52, rotation of the first shaft 52 causes corresponding rotation of the transmission rod 48.

The transmission rod 48 defines a length "$L_R$" (FIG. 4) that is selectively adjustable. For example, the present disclosure contemplates an adjustment in the length "$L_R$" of approximately 2". It is envisioned that variations in the length "$L_R$" of the transmission rod 48 may be accomplished through any suitable means. For example, the transmission rod 48 may include a plurality of telescoping portions (not shown) that would allow for movement of the transmission rod 48 towards and away from the housing 40.

Additionally, as seen in FIG. 4, the transmission rod 48 has a terminal end 64 that includes engagement structure 66. The engagement structure 66 is configured and dimensioned for connection to corresponding structure included on the end boards $\mathbf{14}_A$, $\mathbf{14}_B$ (FIGS. 1, 2), as will be described in further detail below.

Since the transition boxes $\mathbf{22}_A$, $\mathbf{22}_B$ are identical in structure, it should be appreciated that the vertical position of the gear assembly 44 included in the transition box $\mathbf{22}_A$ (FIG. 3) is the same as that of the gear assembly (not shown) included in the transition box $\mathbf{22}_B$ (FIG. 5). Similarly, it should be appreciated that the vertical position of the transmission rod 48 extending from the transition box $\mathbf{22}_A$ is the same as that of the transmission rod (not shown) extending from the transition box $\mathbf{22}_B$.

Figure 6:
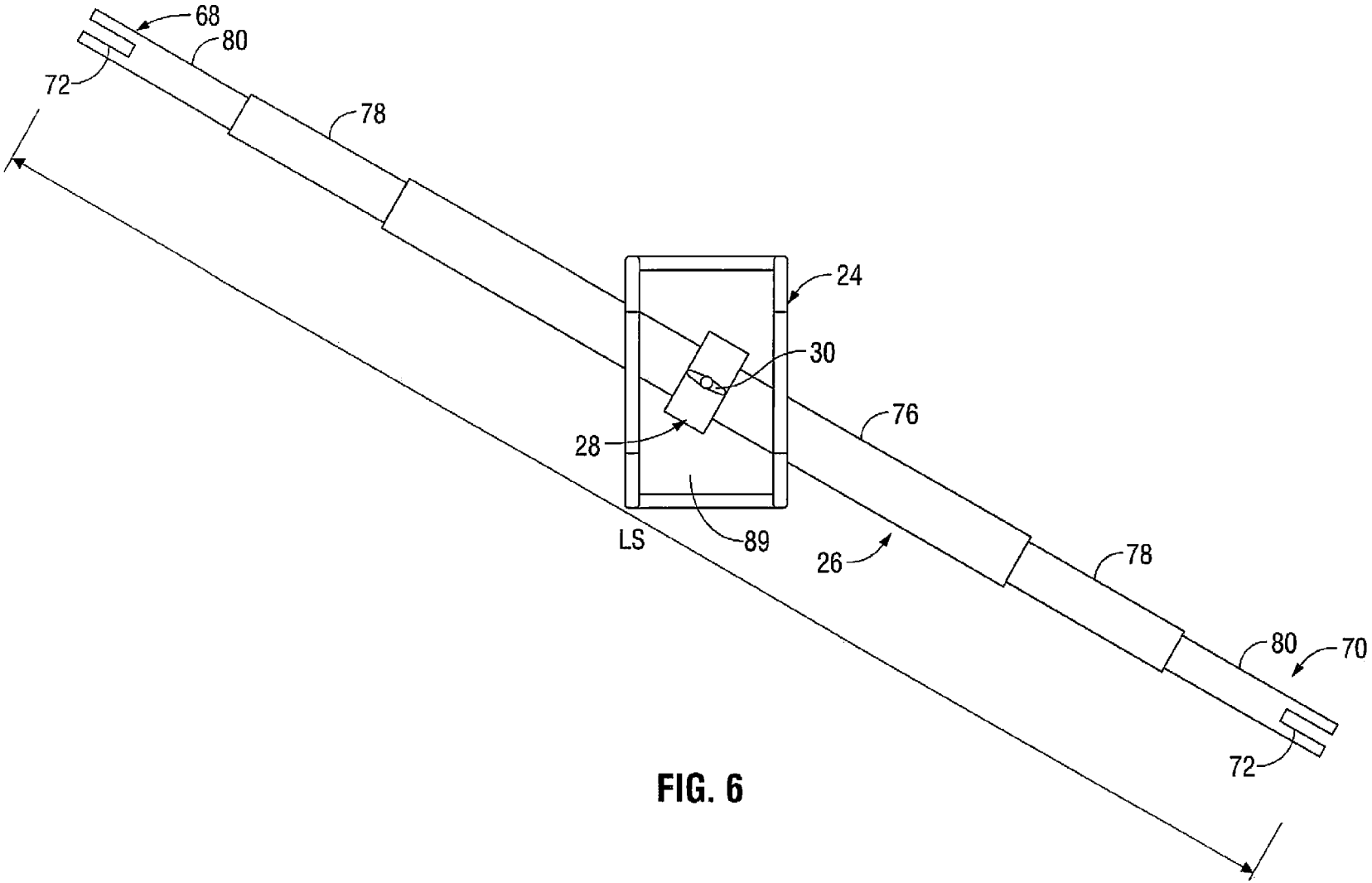
FIG. 6 is a partial, bottom view of the presently disclosed frame assembly illustrating a drive shaft, a cage structure, a ring member, and a screw member.

With reference now to FIGS. 2 and 6, the drive shaft 26 includes a first end 68 that is configured and dimensioned for selective engagement with the first transition box $\mathbf{22}_A$, and a second end 70 that is configured and dimensioned for selective engagement with the second transition box $\mathbf{22}_B$. More specifically, the ends 68, 70 of the drive shaft 26 include structure that is configured and dimensioned for connection to the shafts 52, 56 (FIGS. 3, 5) of the internal gear assemblies 44 positioned within the housing 40 of the transition boxes $\mathbf{22}_A$, $\mathbf{22}_B$. In the particular embodiment of the drive shaft 26 seen in FIGS. 2 and 6, for example, the ends 68, 70 of the drive shaft 26 each include a slot 72 that is configured and dimensioned to receive protrusions 74 (FIGS. 3-5) that extend radially outward from each of the shafts 52, 56. The protrusions 74 are fixedly connected to the shafts 52, 56 such that rotation of the shafts 52, 56 causes corresponding rotation of the protrusions 74, which, in turn, causes corresponding rotation of the drive shaft 26 via engagement of the protrusions 74 and the slots 72. In various embodiments of the present disclosure, it should be understood that the structures included on the drive shaft 26 and the shafts 52, 56 establishing a releasable connection therebetween may be varied without departing from the scope of the present disclosure.

With continued reference to FIGS. 2 and 6, the drive shaft 26 defines a length "$L_S$," and includes a central portion 76, as well as outer portions 78, 80. In the illustrated embodiment of the drive shaft 26, the outer portions 78, 80 are configured and dimensioned for telescopic movement to facilitate variation in the length "$L_S$" of the drive shaft 26. Specifically, as illustrated, the outer portions 80 are configured and dimensioned for reception by the outer portions 78, and the outer portions 78 are configured and dimensioned for reception by the central potion 76.

Additionally, the drive shaft 26 includes structure that is configured and dimensioned to maintain a particular length "$L_S$" of the drive shaft 26. For example, in the embodiment of the drive shaft 26 seen in FIG. 2, the central portion 76 of the drive shaft 26 includes a plurality of openings 82 that are configured and dimensioned to receive depressible buttons 84 that are included on the outer portions 78, 80. During movement of the outer portions 78, 80 relative to the central portion 76 of the drive shaft 26, the buttons 84 engage the openings 82, thereby maintaining a particular length "$L_S$" of the drive shaft 26. To adjust the length "$L_S$" of the drive shaft 26, the buttons 84 can be depressed out of engagement with the openings 82, whereby the outer portions 78, 80 can again be moved relative to the central portion 76.

While the drive shaft 26 is illustrated as including a substantially square cross-sectional configuration, the configuration of the drive shaft 26 may be varied in alternative embodiments without departing from the scope of the present disclosure. Additionally, although illustrated as including the aforedescribed telescoping central portion 76 and outer portions 78, 80, an embodiment of the drive shaft 26 defining a fixed length would not be beyond the scope of the present disclosure. Further, at least a portion of drive shaft 26 may be spring-biased toward a more-extended position, the importance of which will be described in greater detail below. More specifically, a spring (not shown) may be disposed within drive shaft 26 to bias one or more of the telescoping portions outwardly from one another.

Figure 7:
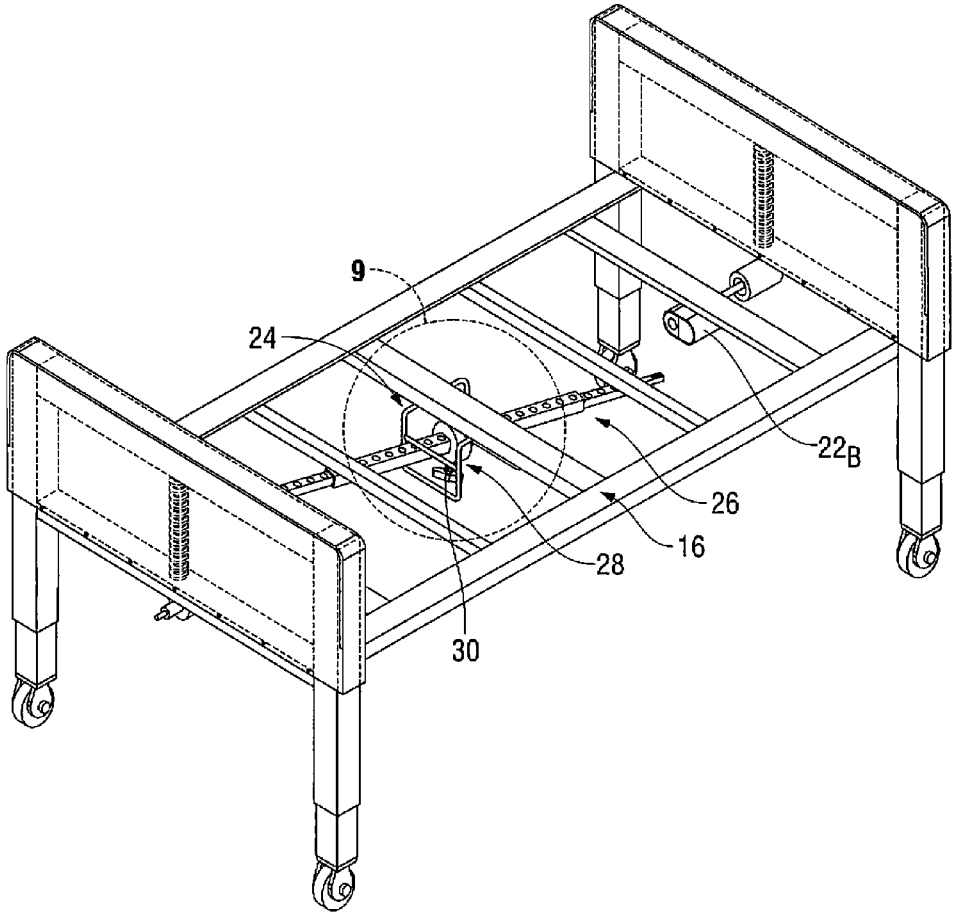
FIG. 7 is a top, perspective view of the presently disclosed bed system.
Figure 8:
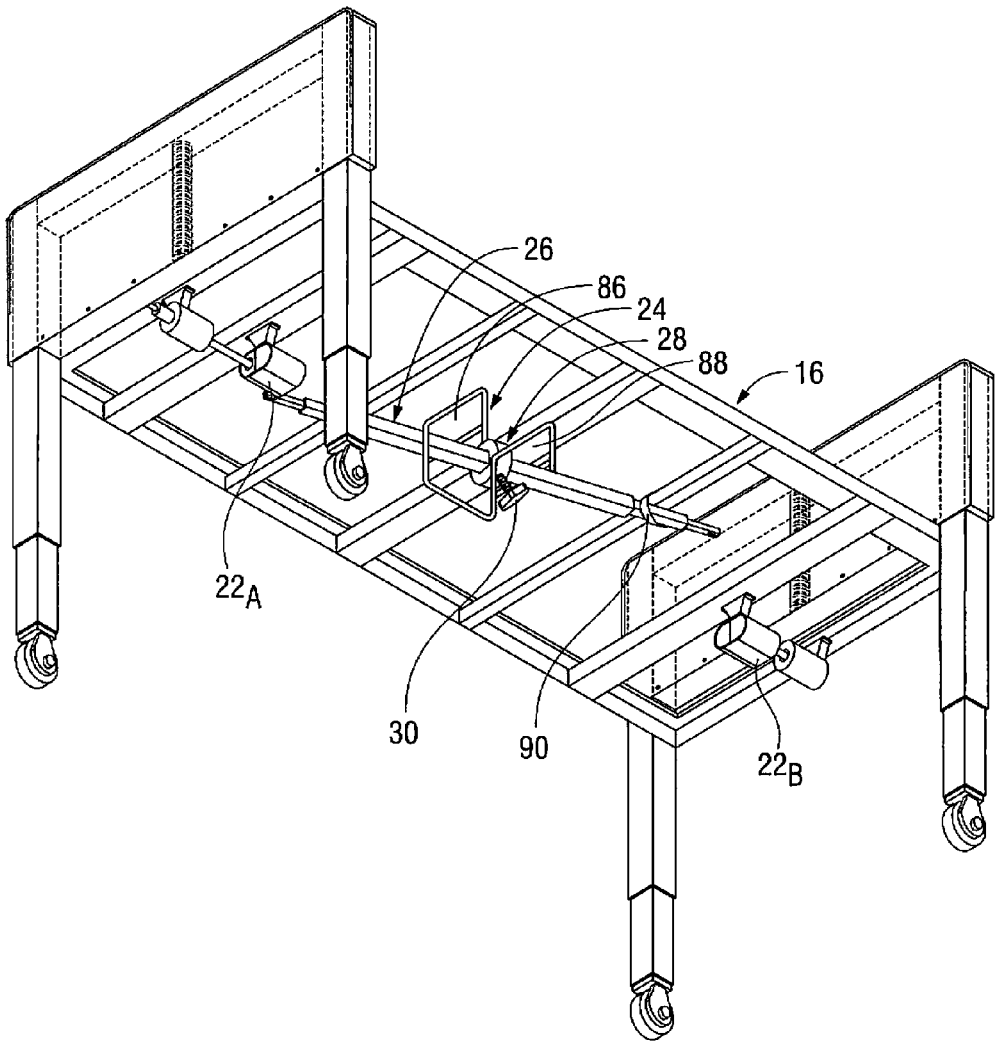
FIG. 8 is a bottom, perspective view of the presently disclosed bed system.

With reference now to FIGS. 6-9, the bracket member, or cage structure 24 will be described. The cage structure 24 is secured to the frame 16 on an underside thereof, and is configured and dimensioned to inhibit relative movement between the drive shaft 26 and the frame 16, e.g., during transport. The cage structure 24 includes respective first and second side openings 86, 88 (FIGS. 8, 9) that are configured and dimensioned to allow the drive shaft 26 to pass therethrough, and defines a substantially U-shaped cross-sectional configuration describing an open bottom portion 89 (FIG. 6). As can be appreciated through reference to FIG. 9, each side opening, e.g., the side opening 86, includes a first inner dimension $D_1$, and a second inner dimension $D_2$. Upon proper connection of the cage structure 24 to the frame 16, the first inner dimension $D_1$ extends vertically, and the second inner dimension $D_2$ extends horizontally. The second (horizontal) inner dimension $D_2$ is such that the position and/or orientation of the drive shaft 26 can be adjusted within the cage structure 24. As seen in FIGS. 7 and 8, for example, the drive shaft 26 can be separated from the transition boxes $\mathbf{22}_A$, $\mathbf{22}_B$, and rotated within the cage structure 24 such that the drive shaft 26 is skewed relative to the frame 16 in order to prevent any damage to the gear assemblies 44 (FIGS. 3-5) of the transition boxes $\mathbf{22}_A$, $\mathbf{22}_B$ during transport. Thereafter, the drive shaft 26 can secured to the frame via an optional securement member 90 (FIG. 8), e.g., a length of Velcro, string, or tape, a clamp, or the like, to further inhibit relative movement between the drive shaft 26 and the frame 16.

With continued reference to FIGS. 6-9, the ring member 28 is configured and dimensioned for positioning within the cage structure 24 via the open bottom portion 89 (FIG. 6) of the cage structure 24. The ring member 28 includes an opening 92 (FIGS. 2, 9) extending therethrough that is configured and dimensioned to receive the drive shaft 26. It is envisioned that the cross-sectional configuration of the opening 92 extending through the screw member 30 may correspond to that of the drive screw 26, e.g., to inhibit relative rotational movement between the ring member 28 and the drive shaft 26. For example, in the embodiment of the drive shaft 26 and the ring member 28 seen in FIGS. 2 and 6, the drive shaft 26 and the opening 92 extending through the ring member 28 are each illustrated as including substantially square cross-sectional configurations. However, alternative cross-sectional configurations for the drive shaft 26 and the opening 92, e.g., elliptical or circular, are not beyond the scope of the present disclosure.

The ring member 28 is configured and dimensioned for cooperative engagement with the aforementioned screw member 30 to inhibit relative movement between the drive shaft 26 and the ring member 28. Specifically, by rotating the screw member 30 relative to the ring member 28, the screw member 30 can be brought into and out of engagement with the drive shaft 26 to fix the position of the drive shaft 26 relative to the ring member 28.

Figure 9:
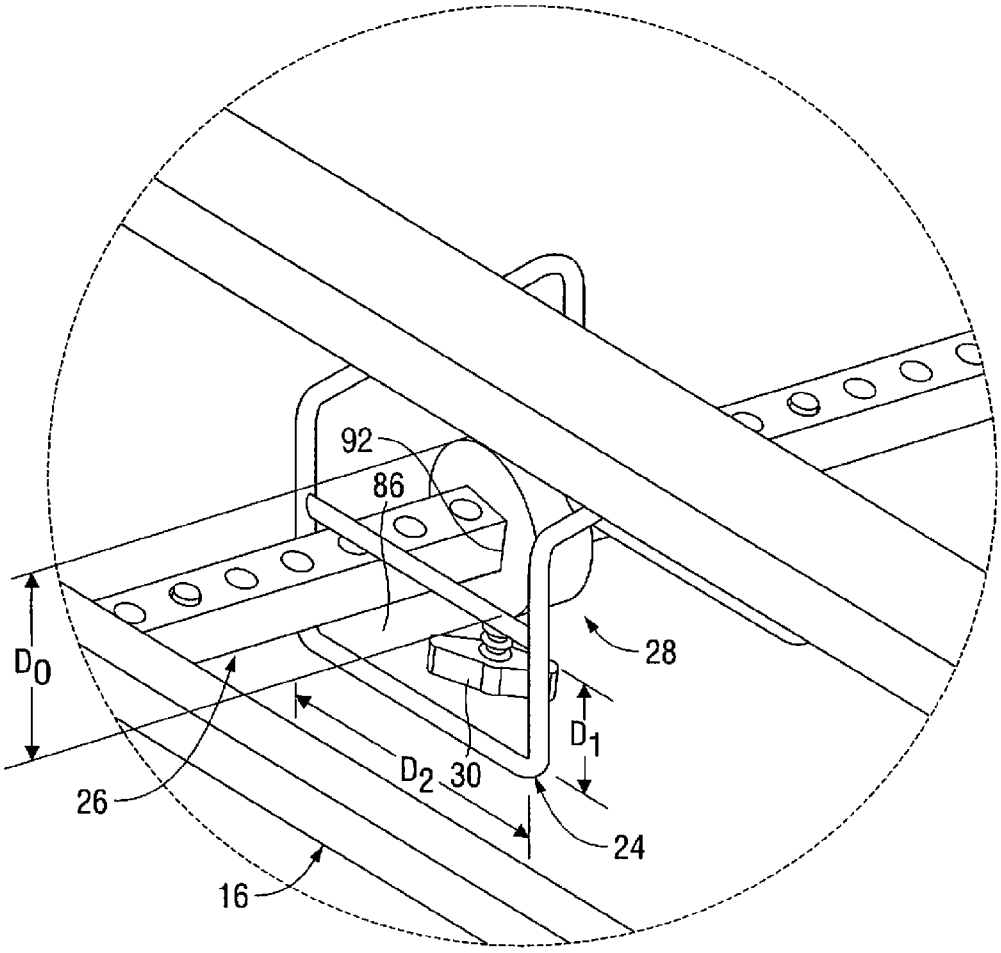
FIG. 9 is an enlarged view of the area of detail indicated in FIG. 7.

With reference to FIG. 9 in particular, the ring member 28 defines an outer dimension $D_O$ that is larger than the first (vertical) inner dimension $D_1$ of the side openings formed in the cage structure 24, e.g., the side opening 86 seen in FIG. 9. As such, when the ring member 28 is positioned within the cage structure 24, and about the drive shaft 26, after tightening of the screw member 30 into engagement with the drive shaft 26, the ring member 28, and consequently, the drive shaft 26, is prevented from passing through the side openings 86, 88 formed in the cage structure 24.

With reference now to FIGS. 1, 2, 10, and 11, the end boards $\mathbf{14}_A$, $\mathbf{14}_B$ will be described. The end board $\mathbf{14}_A$ is positioned at the "foot" of the frame assembly 12, and includes a pair of legs 94 that are connected by an upper cross member 96 (FIGS. 2, 10) and a lower cross member 98. The legs 94 each include an internal hollow portion (not shown) that is configured and dimensioned to receive an inner member 100 such that the legs 94 are vertically movable relative to the inner members 100. As shown, the inner members 100 each include a wheel 102 at their base, which facilitates movement of the bed system 10 as required.

The end board $\mathbf{14}_A$ further includes a height adjustment mechanism $\mathbf{104}_A$ (FIGS. 1, 10), such as that which is described in the '731 patent (U.S. Pat. No. 5,134,731). The height adjustment mechanism $\mathbf{104}_A$ facilitates movement of the legs 94 relative to the inner members 100, and thus, adjustments in the height of the first end board $\mathbf{14}_A$. Given the respective connection between the first and second ends 18, 20 of the frame 16 and the end boards $\mathbf{14}_A$, $\mathbf{14}_B$, any adjustments in the height of the end boards $\mathbf{14}_A$, $\mathbf{14}_B$ will cause a corresponding adjustment in the height of the frame 16.

Although specific details regarding the structure and functionality of the height adjustment mechanism $\mathbf{104}_A$ can be ascertained through reference to the '731 patent, the height adjustment mechanism $\mathbf{104}_A$ will be discussed briefly herein below.

The height adjustment mechanism $\mathbf{104}_A$ includes a rotatable drive screw $\mathbf{106}_A$ that is secured to the upper cross member 96 (FIGS. 2, 10) and the lower cross member 98. The drive screw $\mathbf{106}_A$ is connected to a gear assembly $\mathbf{108}_A$, whereby actuation of the gear assembly $\mathbf{108}_A$ causes rotation of the drive screw $\mathbf{106}_A$ to adjust the height of the end board $\mathbf{14}_A$.

Figure 10:
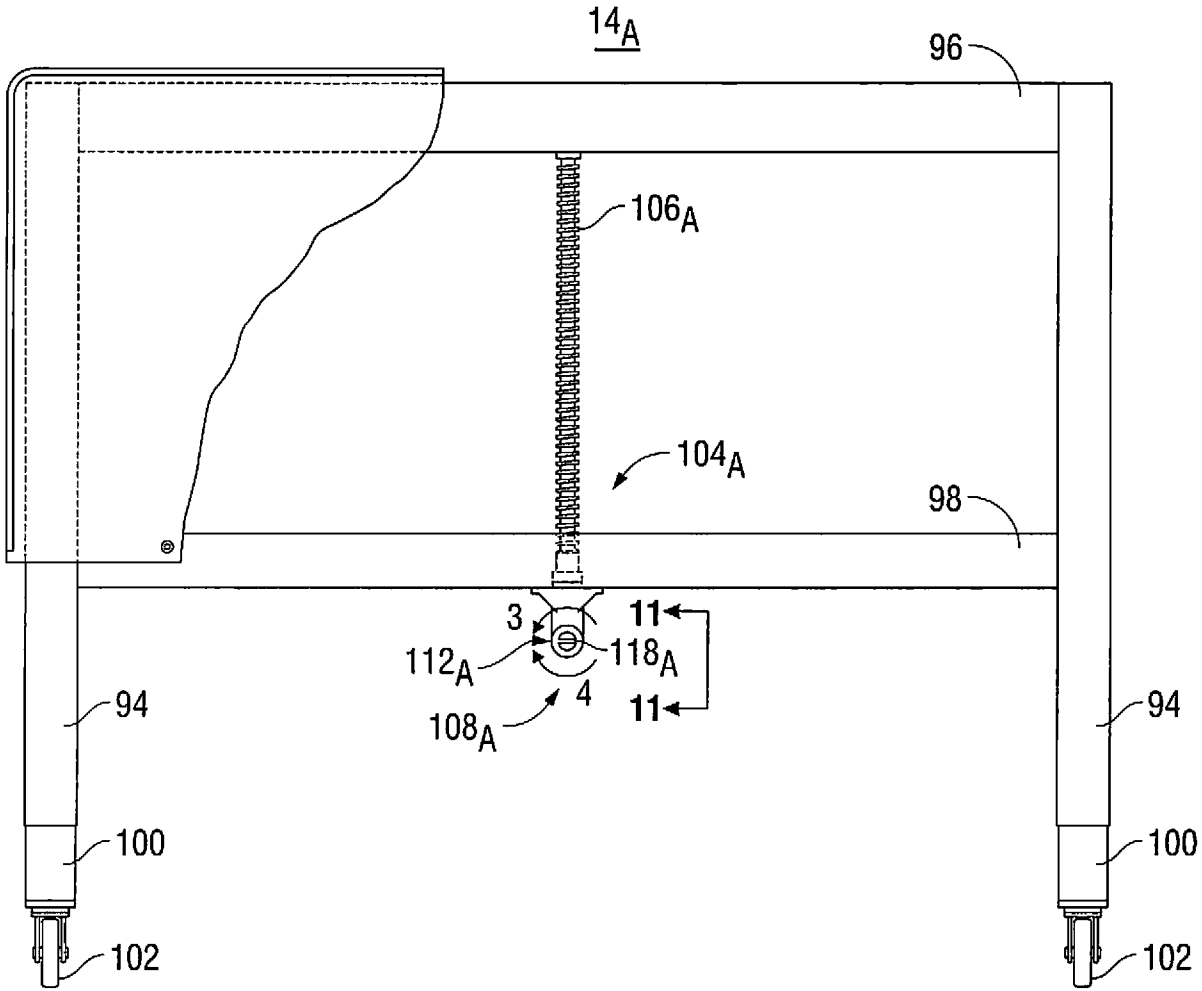
FIG. 10 is a front view of one embodiment of an end board for use in the presently disclosed bed system.
Figure 11:
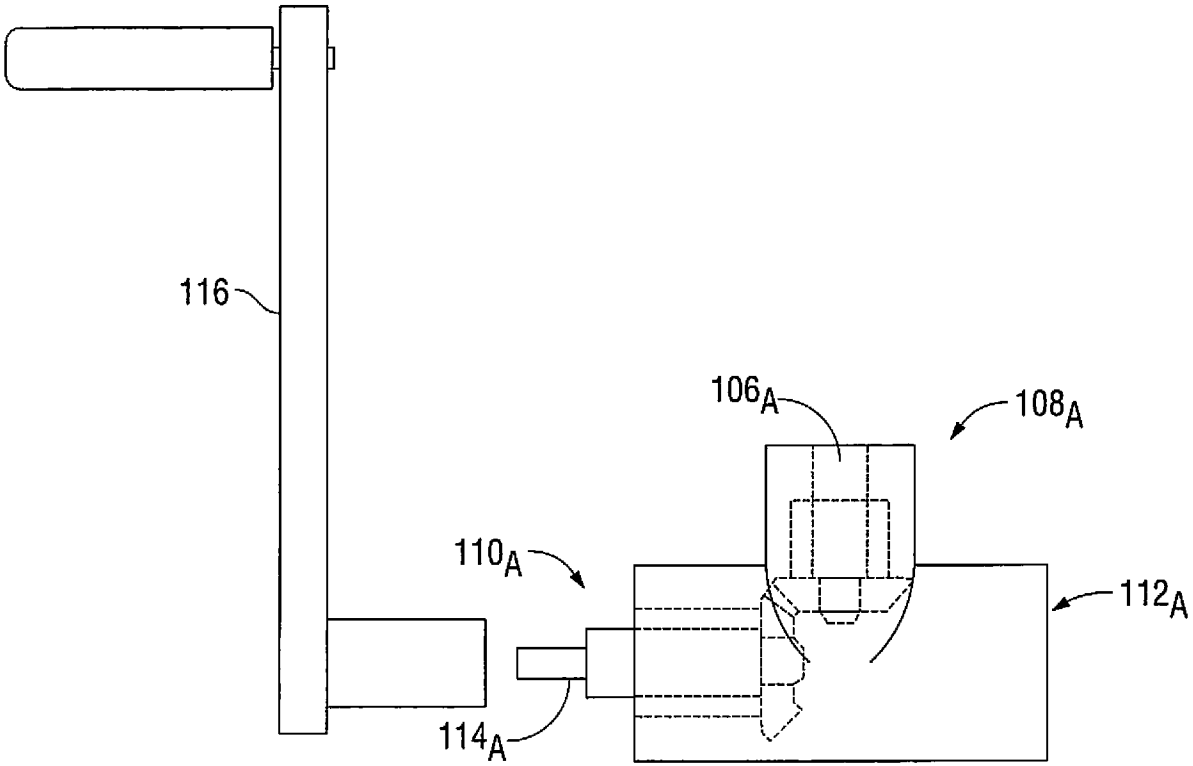
FIG. 11 is a partial, side, cross-sectional view taken along line 11-11 in FIG. 10 illustrating a gear assembly included on the end board of FIG. 10 shown in conjunction with a hand crank.

With particular reference to FIGS. 10 and 11, the gear assembly $\mathbf{108}_A$ includes an input assembly $\mathbf{110}_A$ that is operatively connected to an output assembly $\mathbf{112}_A$. The input assembly $\mathbf{110}_A$ includes a nut 114 that is configured and dimensioned for connection to a rotatable hand crank 116, such that rotation of the hand crank 116 effectuates corresponding rotation of the output assembly $\mathbf{112}_A$, as well as rotation of drive screw $\mathbf{106}_A$ via connection of the drive screw $\mathbf{106}_A$ to the gear assembly $\mathbf{108}_A$. While the gear assembly $\mathbf{108}_A$ is configured and dimensioned for manual actuation in the embodiment seen in FIGS. 1, 2, 10, and 11, the use of an electric motor to control actuation of the gear assembly $\mathbf{108}_A$ in alternative embodiments is also contemplated.

Dependent upon the particular direction of actuation of the gear assembly $\mathbf{108}_A$, e.g., the direction of rotation of the hand crank 116 in FIG. 11, the output assembly $\mathbf{112}_A$ will be caused to rotate either in the direction indicated by arrow 3 (FIG. 10), or in the direction indicated by arrow 4. Additionally, the drive screw $\mathbf{106}_A$ will be caused to rotate such that the legs 94 of the end board $\mathbf{14}_A$ are moved either up, to thereby increase the height of the end board $\mathbf{14}_A$ and the frame 16 (FIGS. 1, 2), or down, to thereby reduce the height of the end board $\mathbf{14}_A$ and the frame 16 (FIGS. 1, 2).

As best seen in FIG. 10, the output assembly $\mathbf{112}_A$ includes receipt structure $\mathbf{118}_A$ that is configured and dimensioned for mechanical connection to the engagement structure 66 (FIG. 4) included at the terminal end 64 of the transmission rod 48 component of the transition box $\mathbf{22}_A$. In this manner, a rotational force applied to the gear assembly $\mathbf{108}_A$ of the height adjustment mechanism $\mathbf{104}_A$, e.g., by rotation of the nut 114 (FIG. 11) via the crank 116, will be transmitted to the transmission rod 48 through the output assembly $\mathbf{112}_A$. Given the connection of the transmission rod 48 to the first shaft 52 (FIG. 4) of the internal gear assembly 44 included in the transition box $\mathbf{22}_A$, rotation of the transmission rod 48 will effectuate corresponding rotation of the first shaft 52, and consequently, rotation of the first and second gears 50, 54 (FIG. 4).

With momentary reference to FIGS. 1 and 2, the end board $\mathbf{14}_B$ will be described. The end board $\mathbf{14}_B$ is positioned at the "head" of the frame assembly 12, and is substantially similar to the first end board $\mathbf{14}_A$, but for the differences detailed below. Given the similarities between the end boards $\mathbf{14}_A$, $\mathbf{14}_B$, the end board $\mathbf{14}_B$ will only be discussed to the extent that it differs from the end board $\mathbf{14}_A$.

The end board $\mathbf{14}_B$ includes a height adjustment mechanism $\mathbf{104}_B$ with a rotatable drive screw $\mathbf{106}_B$ that is connected to a gear assembly $\mathbf{108}_B$. The gear assembly $\mathbf{108}_B$ includes an input assembly $\mathbf{110}_B$ and an output assembly $\mathbf{112}_B$.

Upon assembly of the bed system 10, the end boards $\mathbf{14}_A$, $\mathbf{14}_B$ will be positioned as illustrated in FIGS. 1 and 2. More specifically, the end boards $\mathbf{14}_A$, $\mathbf{14}_B$ will be positioned such that output assembly $\mathbf{112}_A$ of the gear assembly $\mathbf{108}_A$ included on the end board $\mathbf{14}_A$ faces the output assembly $\mathbf{112}_B$ of the gear assembly $\mathbf{108}_B$ included on the end board $\mathbf{14}_B$.

During use, a rotational force will be transmitted through the drive shaft 26 (FIGS. 1, 2) from the height adjustment mechanism $\mathbf{104}_A$ of the end board $\mathbf{14}_A$ to the height adjustment mechanism $\mathbf{104}_B$ of the end board $\mathbf{14}_B$, the particular details of which will be discussed herein below. However, since the end boards $\mathbf{14}_A$, $\mathbf{14}_B$ face each other upon assembly of the bed system 10 (FIGS. 1, 2), uniform adjustment in the height of the frame 16 across the length "L" of the frame 16 (FIG. 2) will require that the respective output assemblies $\mathbf{112}_A$, $\mathbf{112}_B$ of the height adjustment mechanisms $\mathbf{104}_A$, $\mathbf{104}_B$ rotate in opposite directions. To facilitate rotation in opposite directions, the configuration of the gear assembly $\mathbf{108}_A$ is necessarily different from that of the gear assembly $\mathbf{108}_B$. Thus, the end board $\mathbf{14}_A$ differs from the end board $\mathbf{14}_B$ in the configuration of the gear assemblies $\mathbf{108}_A$, $\mathbf{108}_B$ of the respective height adjustment mechanisms $\mathbf{104}_A$, $\mathbf{104}_B$. Were the configurations of the gear assemblies $\mathbf{108}_A$, $\mathbf{108}_B$ identical, upon rotation of the crank 116 (FIG. 11), the end boards $\mathbf{14}_A$, $\mathbf{14}_B$ would move in opposite directions, e.g., the height of the end board $\mathbf{14}_A$ would be increased, whereas the height of the end board $\mathbf{14}_B$ would be decreased, or vice versa.

With reference now to FIGS. 1-12, the use and operation of the presently disclosed frame assembly 12 will be discussed in connection with the aforedescribed end boards $\mathbf{14}_A$, $\mathbf{14}_B$ (FIGS. 1, 2).

Initially, the end boards $14_A$, $14_B$ are positioned as illustrated in FIGS. 1 and 2, i.e., such that the output assembly $112_A$ (FIGS. 1, 10) of the height adjustment mechanism $104_A$ included on the end board $14_A$ faces the output assembly $112_B$ (FIGS. 1, 2, 12) of the height adjustment mechanism $104_B$ included on the end board $14_B$. Thereafter, the frame 16 is secured to the end boards $14_A$, $14_B$, and the transition boxes $22_A$, $22_B$ are respectively connected to the height adjustment mechanisms $104_A$, $104_B$. More specifically, the transmission rod 48 (FIGS. 2-4) of the transition box $22_A$ is connected to the output assembly $112_A$, and the transmission rod 48 (FIGS. 2, 5) of the transition box $22_B$ is connected to the output assembly $112_B$.

Either prior, or subsequent, to respective connection of the transition boxes $22_A$, $22_B$ and the height adjustment mechanisms $104_A$, $104_B$ of the end boards $14_A$, $14_B$, the drive shaft 26 (FIGS. 2, 12) is connected to the transition boxes $22_A$, $22_B$. Specifically, the door 62 (FIG. 3) included on the housing 40 is adjusted to expose either the first gear 50, i.e., the gear identified by the letter "A," or the second gear 54, i.e., the gear identified by the letter "B." For the purposes of discussion, the drive shaft 26 will be described herein below as being connected to the first gear 50 of the transition box $22_A$. However, it should be understood that, in the alternative, the drive shaft 26 may be connected to the second gear 54 without disrupting operation of the bed system 10. To connect the drive shaft 26 to the first gear 50, the slot 72 (FIGS. 6, 12) included at the first end 68 of the drive shaft 26 is positioned about the protrusions 74 (FIGS. 3, 4) that are included on the first shaft 52.

Figure 12:
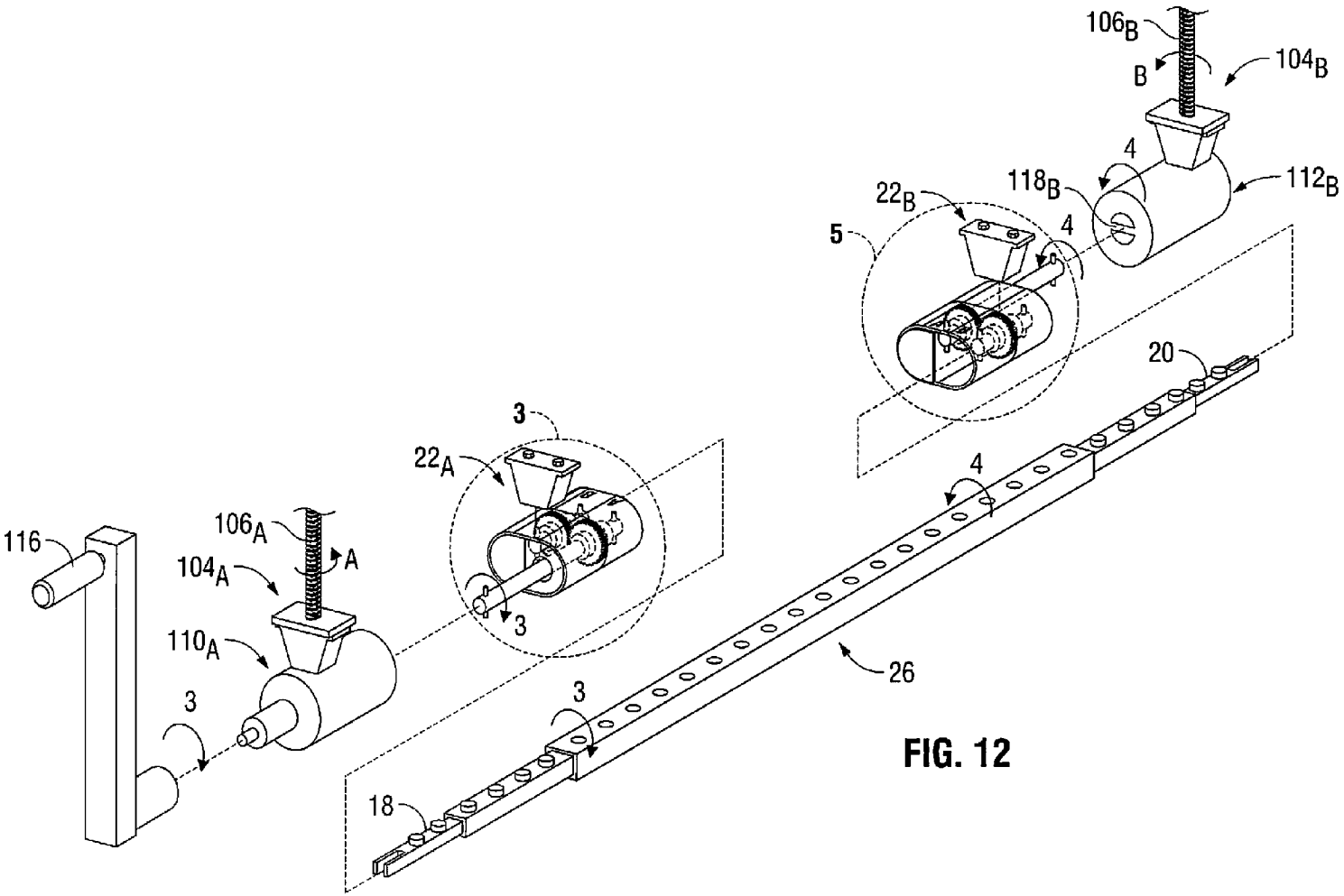
FIG. 12 is a partial, perspective view of the presently disclosed bed system with parts separated.

At the opposite end of the frame 16, the door 62 (FIG. 3) included on the housing 40 of the second transition box $22_B$ (FIGS. 1, 2) is adjusted to expose one of the first and second gears 50, 54. In order to realize uniform adjustments in the height of the frame 16, the drive shaft 26 must be connected to opposite gears in the transition boxes $22_A$, $22_B$. For instance, in the preceding example, since the first end 68 (FIGS. 2, 6) of the drive shaft 26 is described as being connected to the first gear 50, i.e., the gear identified by the letter "A" (FIG. 3) on the housing 40, the second end 70 (FIGS. 2, 6) of the drive shaft 26 must be connected to the gear identified by the letter "B" on the housing 40 of the second transition box $22_B$, i.e., the second gear 54, as shown in FIG. 12. Since the first gear 50 (FIG. 3) of the first transition box $22_A$ and the second gear 54 (FIG. 5) of the second transition box $22_B$ are configured for rotation in opposite directions, the force transmitted from the height adjustment mechanism $104_A$ (FIGS. 1, 12) through the transition boxes $22_A$, $22_B$ and the drive shaft 26 will cause the drive screws $106_A$, $106_B$ (FIGS. 1, 2, 12) to rotate in opposite directions, thereby causing the end boards $14_A$, $14_B$ (FIGS. 1, 2), and consequently, the frame 16, to move in the same direction.

With primary reference now to FIGS. 3, 5, and 12, following connection of the drive shaft 26 to the transition boxes $22_A$, $22_B$, a rotational force is applied to either of the height adjustment mechanisms $104_A$, $104_B$ via one of the respective input assemblies $110_A$, $110_B$, e.g., via rotation of the hand crank 116. In the description below, while the hand crank 116 will be discussed in connection with the height adjustment mechanism $104_A$, it should be appreciated that, in the alternative, the hand crank 116 could be utilized in connection with the height adjustment mechanism $104_B$ without disrupting operation of the bed system 10.

Upon rotation of the hand crank 116, e.g., in the direction indicated by arrow 3 (FIG. 12), the height of the end board $14_A$ (FIGS. 1, 2) will adjusted by the application of a rotational force to the drive screw $106_A$. Given the particular direction of rotation of the hand crank 116, i.e., the direction indicated by arrow 3 in FIG. 12, the drive screw $106_A$ will be caused to rotate in the direction indicated by arrow A to thereby increase the height of the end board $14_A$ (FIGS. 1, 2), and consequently, the height of the first end 18 (FIG. 2) of the frame 16. The drive screw $106_A$ is caused to rotate due to (i) the connection of the input assembly $110_A$ (FIG. 12), which engages the hand crank 116, to the output assembly $112_A$; and (ii) connection of the output assembly $112_A$ to the drive screw $106_A$ via the gear assembly $108_A$ (FIGS. 1, 11).

Concomitantly, with rotation of the drive screw $106_A$, the transmission rod 48 of the transition box $22_A$ will be caused to rotate, also in the direction indicated by arrow 3 (FIG. 12), due to the connection established via mechanical cooperation of the receipt structure $118_A$ (FIG. 10) of the output assembly $112_A$ with the engagement structure 66 (FIG. 3) included at the terminal end 64 of the transmission rod 48. Rotation of the transmission rod 48 will effectuate corresponding rotation of the first shaft 52, also in the direction indicated by arrow 3, which will in turn cause rotation of the respective first and second gears 50, 54 of the gear assembly 44. More specifically, the respective first and second gears 50, 54 will be caused to rotated in opposite directions, e.g., the first gear 50 will rotate in the direction indicated by arrow 3, whereas the second gear 54 will rotate in the direction indicated by arrow 4.

Since the first end 18 (FIG. 12) of the drive shaft 26 engages the first shaft 52 of the gear assembly 44, the drive shaft 26 will also be caused to rotate in the direction indicated by arrow 3. The rotational force applied to the drive shaft 26 will be transmitted to the second transition box $22_B$ via the connection between the second end 20 of the drive shaft 26, and the second shaft 56 (FIG. 5) of the gear assembly 44, whereby the second shaft 56 will be caused to rotate in the direction indicated by arrow 3. Upon rotation of the second shaft 56, the second gear 54 in the second transition box $22_B$ will also be caused to rotate in the direction indicated by arrow 3, i.e., in the same direction as the first gear 50 in the first transition box $22_A$. However, rotation of the second gear 54 (FIG. 5) will cause rotation of the first gear 50, and consequently, the first shaft 52, in the opposite direction, i.e., in the direction indicated by arrow 4, due to the mating engagement of the gears 50, 54 via the teeth 58, 60 (FIG. 5). The transmission rod 48 of the second transition box $22_B$ will also be caused to rotate in the direction indicated by arrow 4 due to the mechanical connection of the transmission rod 48 to the first shaft 52.

Given the connection between the transmission rod 48 and the output assembly $112_B$ (FIG. 12) of the height adjustment mechanism $104_B$, the output assembly $112_B$, will be caused to rotate in the direction indicated by arrow 4. Consequently, due to the connection between the output assembly $112_B$ and the drive screw $106_B$ via the gear assembly $104_B$ (FIGS. 1, 12), the drive screw $106_B$ will be caused to rotate in the direction indicated by arrow B (FIG. 12). As shown in FIG. 12, the respective directions of rotation A, B of the drive screws $106_A$, $106_B$ are opposite each other. As such, the height of the end board $14_B$ (FIGS. 1, 2), and consequently, the height of the second end 20 (FIG. 2) of the frame 16, will be raised, thereby resulting in uniform adjustment in the height of the frame 16 along the length "L" (FIG. 2).

Figure 13:
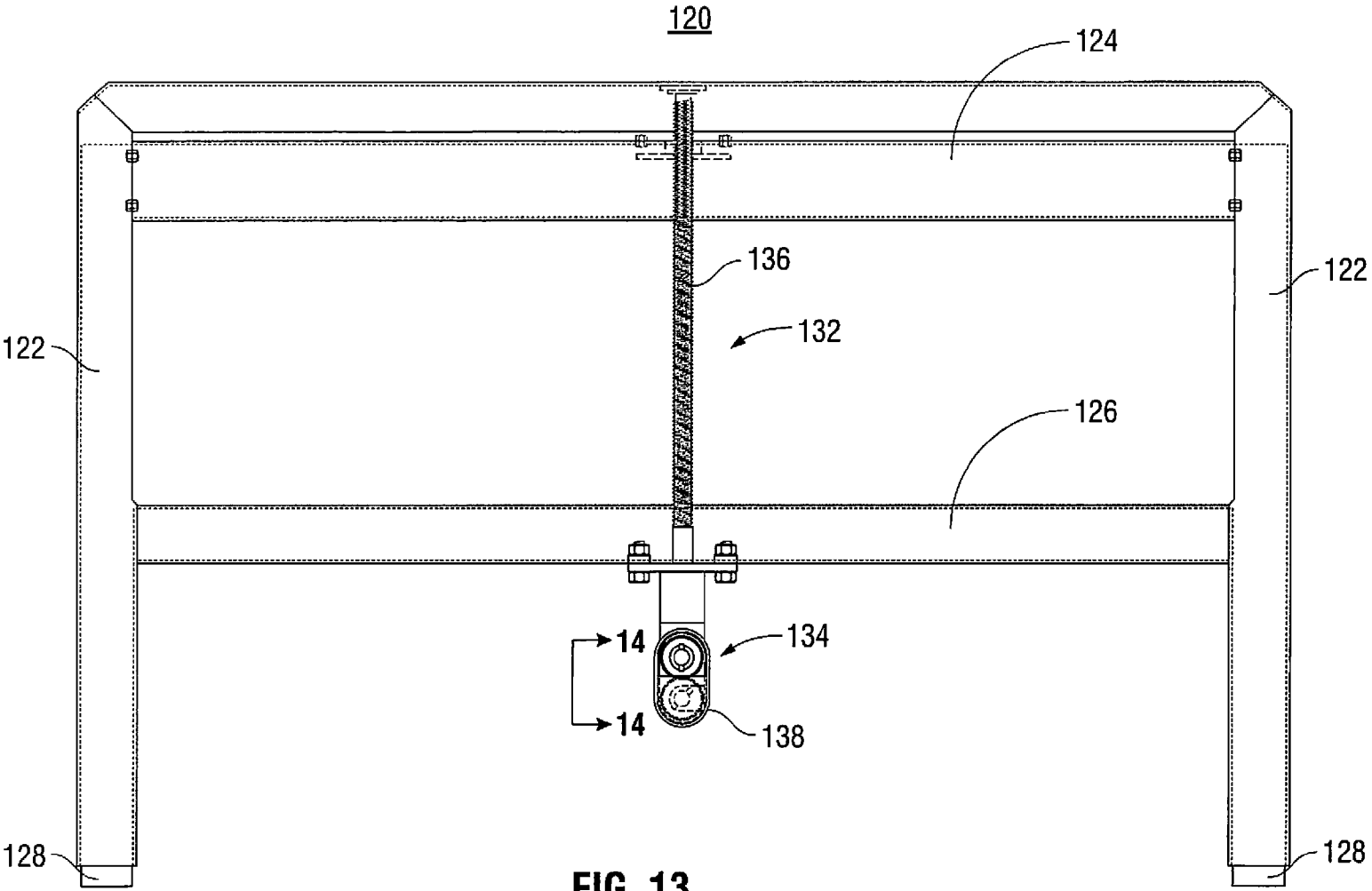
FIG. 13 is a front view of an alternative embodiment of an end board for use in the presently disclosed bed system.
Figure 14:
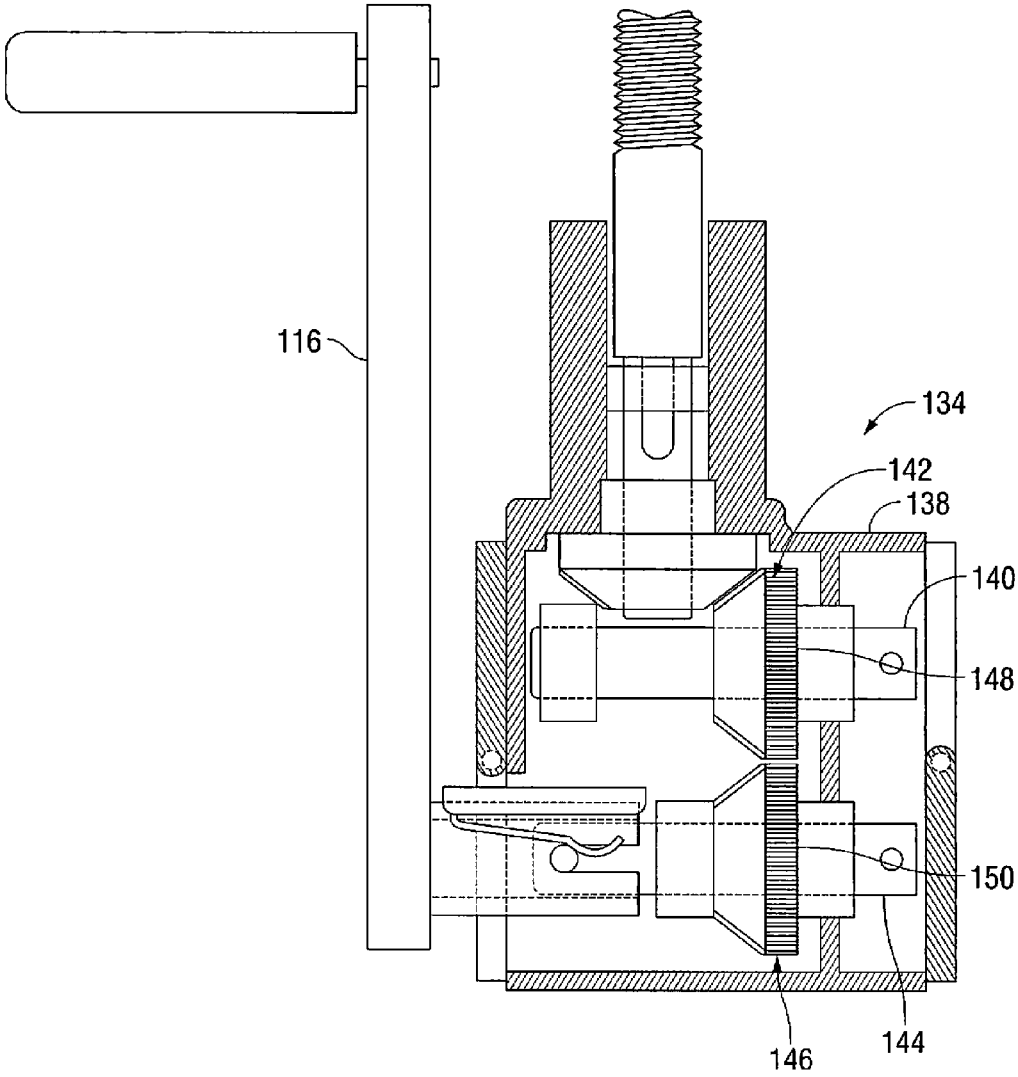
FIG. 14 is a side, cross-sectional view taken along line 14-14 in FIG. 13 illustrating a gear assembly included on the end board of FIG. 13 shown in conjunction with a hand crank.

Referring now to FIGS. 13 and 14, in another aspect of the present disclosure, the frame assembly 12 discussed above in connection with FIGS. 1-12, may be used in connection with a pair of end boards identified by the reference character 120, only one of which is shown. Each end board 120 is characterized as either a "headboard" or a "footboard" based upon its positioning relative to the frame 16.

In contrast to the end boards $14_A$, $14_B$ discussed above with respect to FIGS. 1, 2, and 10, for example, each end board 120 is identical in structure and operation. As such, the end boards 120 are interchangeable with one another. One example of such an end board is described in U.S. Pat. No. 6,983,495 ("the '495 patent"), for example. Although specific details regarding the structure and functionality of each end board 120 can be ascertained through reference to the '495 patent, the end boards 120 will be discussed briefly herein below.

Each end board 120 includes a pair of legs 122 that are connected by an upper cross member 124 and a lower cross member 126. The legs 122 each include an internal hollow portion (not shown) that is configured and dimensioned to receive an inner member 128 such that the legs 122 are vertically movable relative to the inner members 128.

Each end board 120 further includes a height adjustment mechanism 132 that facilitates movement of the legs 122 relative to the inner members 128 to allow for variations in the height of the end board 120. The height adjustment mechanism 132 includes a gearbox 134, and a drive screw 136 that is secured to the respective upper and lower cross members 124, 126. The drive screw 136 is connected to the gearbox 134 such that actuation of the gearbox 134 causes rotation of the drive screw 136 to adjust the height of the end board 120.

One gearbox 134 is fixed to each end board 120. Each gearbox 134 includes a housing 138 that accommodates an upper shaft 140 and an upper gear assembly 142, as well as a lower shaft 144 and a lower gear assembly 146. The upper and lower gear assemblies 142, 146 respectively include a plurality of teeth 148, 150, which cause meshing engagement of the upper and lower gear assemblies 142, 146 such that rotation of the upper gear assembly 142 in one direction causes simultaneous rotation of the lower gear assembly 146 in the opposite direction.

As can be appreciated through reference to FIGS. 13 and 14, given the vertical orientation of the respective upper and lower gear assemblies 142, 146, the distance between the upper gear assembly 142 and the frame 16 (FIGS. 1, 2) will be different than the distance between the lower gear assembly 146 and the frame 16.

During use, a drive shaft, such as the aforedescribed drive shaft 26 seen in FIGS. 1 and 2, for example, extends between the gearboxes 134 included on the end boards 120. Specifically, the first end 68 (FIG. 2) of the drive shaft 26 engages the upper shaft 140 (FIG. 14) of one gear box, i.e., the gearbox 134 included on the headboard, and the second end 70 (FIG. 2) of the drive shaft 26 engages the lower shaft 144 (FIG. 14) of the other gear box, i.e., the gear box 134 included on the footboard.

Upon actuation of the headboard gearbox 134, for example, the upper shaft 140 and the upper gear assembly 142 rotate in a first direction, which causes corresponding rotation of the drive shaft 26 (FIG. 2), as well as the headboard drive screw 136 (FIG. 13), to thereby adjust the height of the headboard.

Rotation of the drive shaft 26 (FIG. 2) causes simultaneous actuation of the gearbox 134 included on the footboard. Specifically, the drive shaft 26 causes the lower shaft 144 (FIG. 14) and the lower gear assembly 146 to rotate, also in the first direction. However, due to the meshing engagement of the lower gear assembly 146 with the upper gear assembly 142, the upper gear assembly 142 is caused to rotate in a second direction opposite to the first direction. Rotation of the upper gear assembly 142 in the second direction causes corresponding rotation of the footboard drive screw 136 to thereby adjust the height of the footboard.

Since the upper gear assemblies 142, 146 of the gearboxes 134 included on the headboard and the footboard are caused to rotate in opposite directions, the drives screws 136 (FIG. 13) respectively included on the headboard and footboard will also rotate in opposite directions, thereby causing uniform adjustment in the height of the headboard and the footboard.

With reference now to FIGS. 1-5, 13, and 14, the use and operation of the presently disclosed frame assembly 12 (FIGS. 1, 2) will be discussed in connection with identical end boards, e.g., a headboard and a footboard similar to the end board 120 (FIG. 13) described above, and disclosed in the '495 patent.

Initially, the first end 18 (FIG. 2) of the frame 16 is secured to a first end board 120 (FIG. 13), e.g., a footboard, and the second end 20 (FIG. 2) of the frame 16 is secured to a second end board 120 (FIG. 13), e.g., a headboard, such that the gearboxes 134 face each other. Thereafter, the transition box $22_A$ (FIGS. 1, 2) is connected to the height adjustment mechanism 132 (FIG. 13) on the footboard, and the transition box $22_B$ (FIGS. 1, 2) is connected to the height adjustment mechanism 132 (FIG. 13) on the headboard. Specifically, the transmission rod 48 (FIGS. 2-4) of the transition box $22_A$ is secured to the gear box 134 (FIG. 13) on the footboard, and the transmission rod 48 (FIGS. 2, 5) of the transition box $22_B$ is secured to gear box 134 on the headboard.

The shaft 140, 142 (FIG. 14) to which the transmission rod 48 (FIGS. 2-4) of the transition box $22_A$ is secured will determine which shaft 140, 142 is connected to the transmission rod 48 of the transition box $22_B$. For example, if the transmission rod 48 of the transition box $22_A$ is secured to the upper shaft 140 of the footboard gearbox 134, then the transmission rod 48 of the transition box $22_B$ will be secured to the lower shaft 144 of the headboard gearbox 134, whereas securing the transmission rod 48 of the transition box $22_A$ to the lower shaft 144 of the footboard gearbox 134 will require securement of the transmission rod 48 of the transition box $22_B$ to the upper shaft 140 of the headboard gearbox 134.

Either prior, or subsequent, to respective connection of the transition boxes $22_A$, $22_B$ (FIGS. 1, 2) with the gearboxes 134 (FIGS. 13, 14) included on the end boards 120, the drive shaft 26 is connected to the transition boxes $22_A$, $22_B$ in the manner discussed above.

Following connection of the drive shaft 26 to the transition boxes $22_A$, $22_B$, a rotational force is applied to one of the gearboxes 134 (FIGS. 13, 14) included on the end boards 120, either manually, or via motorized actuation.

Upon actuation of one of the gearboxes 134, e.g., the gearbox 134 included on the footboard, a rotational force will be transmitted to the footboard drive screw 136 to thereby adjust the height of the footboard. Concomitantly, the transmission rod 48 (FIGS. 2-4) of the transition box $22_A$, which is connected to the gear box 134, will be caused to rotate in a first direction due to the connection between the transmission rod 48 and the upper shaft 140 (FIG. 14) in the present example.

Rotation of the transmission rod 48 (FIGS. 2-4) of the transition box $22_A$ in the first direction will cause rotation of the transmission rod 48 (FIGS. 2, 5) of the transition box $22_B$ in the same direction via the series of mechanical connections discussed above with respect to FIGS. 1-12, e.g., via connection of the transition boxes $22_A$, $22_B$ to the drive shaft 26 (FIGS. 1, 2). Concomitantly with rotation of the transmission rod 48 (FIGS. 2, 5) of the transition box $22_B$, the lower shaft 144 (FIG. 14) of the gearbox 134, to which the drive shaft 26 (FIGS. 1, 2) is connected in the present example, will also be caused to rotate in the first direction. Due to the meshing engagement of the respective upper and lower gear assemblies 142, 146 (FIG. 14), the upper gear assembly 142 of the headboard gearbox 134 will be rotated in a second direction opposite the first direction, which will thereby cause corresponding rotation of the headboard drive screw 136 (FIG. 13) in the direction opposite that of the footboard drive screw 136 to adjust the heights of the end boards 14 uniformly, as previously described.

As mentioned above, it is contemplated herein that the length "$L_R$" (FIG. 4) of the transmission rods 48 included on the transition boxes $\mathbf{22}_A$, $\mathbf{22}_B$ (FIGS. 1, 2) may be adjusted, e.g., during assembly of the bed system 10. The adjustable length "$L_R$" (FIG. 4) of the transmission rods 48 renders the presently disclosed frame assembly 12 (FIGS. 1, 2) compatible with a variety of end boards, e.g., the dissimilar end boards $\mathbf{14}_A$, $\mathbf{14}_B$ discussed above with respect to FIGS. 1, 2, and 10, or the identical end boards 120 discussed above with respect to FIGS. 13 and 14, by relaxing design tolerances, and allowing for adjustments to compensate for dimensional inconsistencies.

Additionally, the compatibility of the presently disclosed frame assembly 12 (FIGS. 1, 2) with various end boards is increased by the aforedescribed adjustability in the length "Ls" (FIG. 2) of the drive shaft 26, which further relaxes design tolerances, and allows for additional adjustments to compensate for dimensional inconsistencies.

Turning now to FIGS. 15-19, another embodiment of an adjustable bed system provided in accordance with the present disclosure is shown generally identified by reference numeral 200. Bed system 200 is similar to bed system 10, described above, and, thus, only the differences therebetween will be described in detail, while similar aspects between bed systems 10, 200 will be either summarily described or omitted entirely to avoid unnecessary repetition. Further, although bed systems 10, 200 are shown including various different features, it is envisioned that the various different features of bed systems 10, 200 may be interchangeable with one another. In other words, any or all of the features discussed herein with respect to bed systems 10, 200 may also be used in conjunction with the other bed system 10, 200 to the extent that they are consistent with one another.

As shown in FIG. 15, bed system 200 includes a frame assembly 212, and a pair of end boards $\mathbf{14}_A$, $\mathbf{14}_B$ that are secured to opposite ends of the frame assembly 212. The frame assembly 212 includes a frame 216 with respective first and second ends 218, 220, respectively. A transition box 222 is coupled to one of the first and second ends, e.g., first end 218. A drive shaft 26 is removably disposed between first and second ends 218, 220, respectively. A bracket member 220 extends downwardly from frame 216 to support drive shaft 26 extending therealong. The first end 218 of the frame 216 is secured to the end board $\mathbf{14}_A$, and the second end 220 of the frame 216 is secured to the end board $\mathbf{14}_B$. Frame 216 may further include a metallic mesh 300 disposed thereon, as will be described below with reference to FIGS. 17-18. End boards $\mathbf{14}_A$, $\mathbf{14}_B$, or any other suitable end board may be configured for use with bed system 200. End boards $\mathbf{14}_A$, $\mathbf{14}_B$ are described in detail above and, thus, will not be described hereinbelow.

With reference now to FIGS. 15-16, transition box 222 will be described. The transition box 222 includes a mounting structure 236 that facilitates connection of the transition box 222 to the frame 216 adjacent the first end 218 thereof. Mounting structure 236 extends downwardly from frame 216 (although outer configurations are contemplated) to engage housing 240 of transition box 222. Housing 240 accommodates the internal components of transition box 222 and includes a first end 242 with an internal gear assembly 244, and a second end 246 with a transmission rod 248 that extends outwardly therefrom.

The internal gear assembly 244 includes first and second gears 250, 254, respectively, that are operably engaged to one another, i.e., wherein the teeth of the first and second gears 250, 254 are disposed in meshed, or mating relation with one another, in vertical registration relative to one another, as best shown in FIG. 16. First gear 250 is fixedly supported on a first shaft 252, which extends towards first end 242 of housing 240. First shaft 252 is also fixedly secured to, or monolithically formed with, transmission rod 248 in coaxial alignment therewith. As mentioned above, transmission rod 248 extends from second end 246 of housing 240. Second gear 254 is supported on a second shaft 256 that is offset relative to first shaft 252 and, thus, transmission rod 248. Second shaft 256, similar to first shaft 252, extends towards first end 242 of housing 240. As can be appreciated, rotation of first shaft 252 in a first direction rotates transmission rod 248 in a similar direction. On the other hand, rotation of second shaft 256 in the first direction rotates second gear 254 in that first direction, thereby rotating first gear 250 and, thus, transmission rod 248 in an opposite direction. Markings U and L (marking the upper, or first gear 250 and the lower, or second gear 254, respectively) may be provided on the outer surface of housing 240 to help distinguish between first and second gears 250, 254, respectively, and the corresponding modes of operation thereof, which will be described hereinbelow.

With continued reference to FIGS. 15-16, drive shaft 26 includes a first end 68 that is configured and dimensioned for selective engagement with the transition box 222, and a second end 70 that is configured and dimensioned for selective engagement directly to end board $\mathbf{14}_B$. More specifically, first end 68 of drive shaft 26 include structure that is configured and dimensioned for releasable and selective connection to both first and second shafts 252, 256 of the internal gear assembly 244 positioned within housing 240 of transition boxes 222. Second end 68 may include similar structure to releasably connect to end board $\mathbf{14}_B$.

Figure 17:
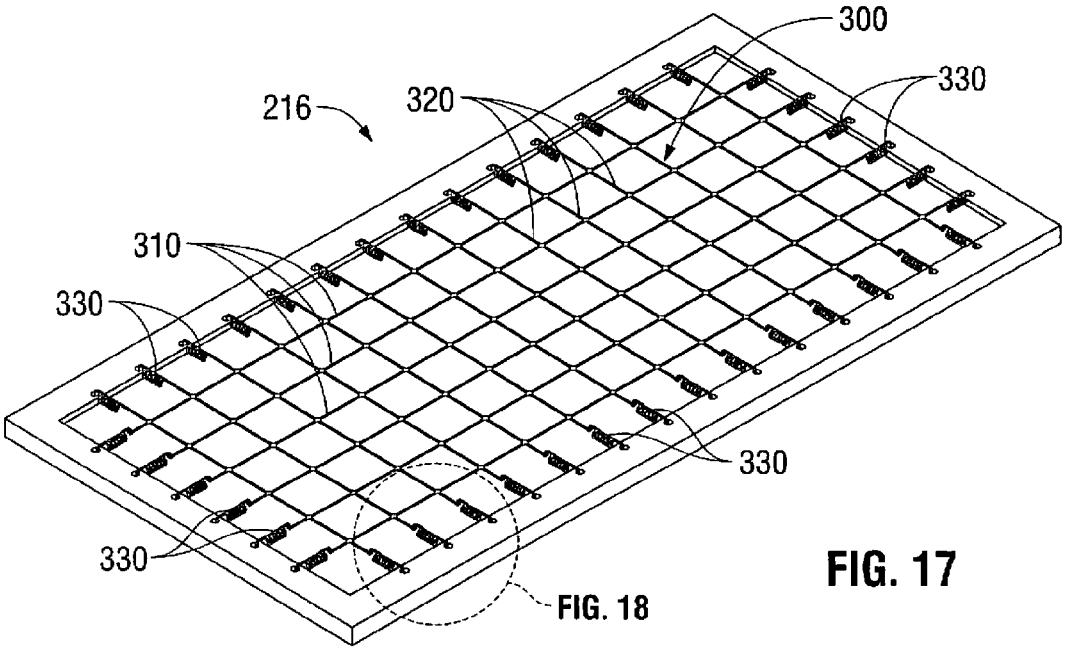
FIG. 17 is a top, perspective view of the bed frame of the adjustable bed system of FIG. 15.
Figure 18:
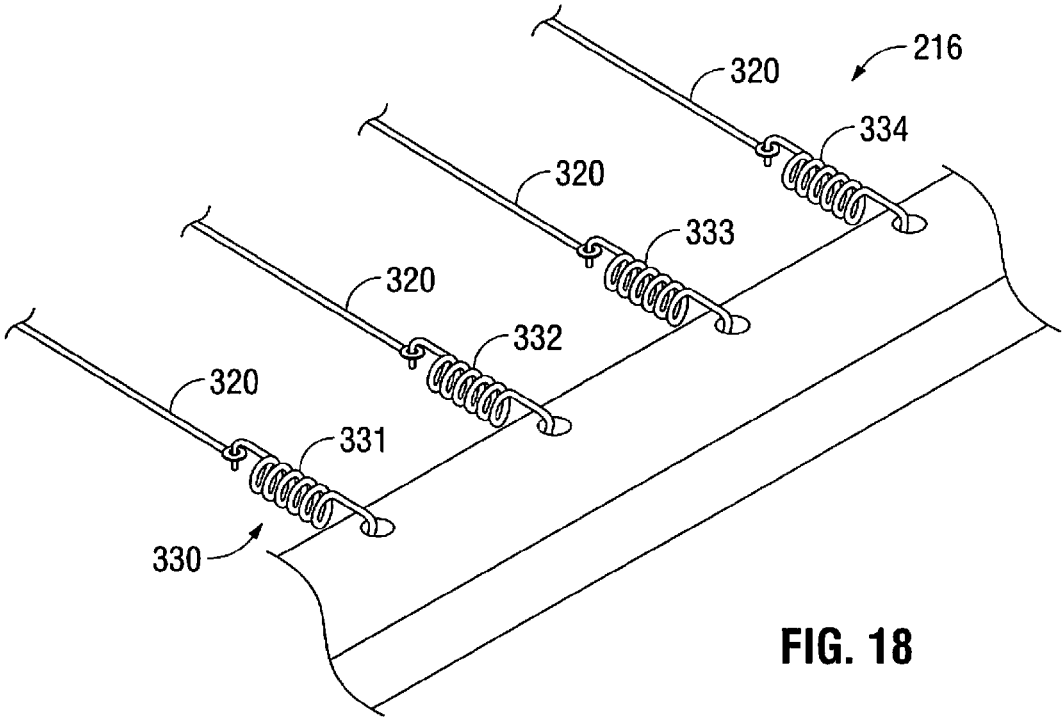
FIG. 18 is an enlarged, perspective view of the area of detail of FIG. 17.

Referring now to FIGS. 17-18, as mentioned above, bed frame 216 may include a resilient metallic mesh 300 disposed thereon that is configured to resiliently support the mattress (not shown) thereon. Mesh 300 includes a plurality of longitudinal wires 310 and a plurality of lateral wires 320 that are inter-woven with one another to form mesh 300. A coil spring 330 is disposed at either or both ends of each of wires 310, 320 to resiliently secure mesh 300 about frame 216. More particularly, frame 216 includes a plurality of apertures define through an outer periphery thereof for securing coil springs 330 thereto. As best shown in FIG. 18, coil springs 330 may be color-coded, or otherwise distinguished to facilitate assembly and/or use of bed system 200. For example, coil springs 331, 333 and 334 may be uncolored, e.g., silver, while coil spring 332 is painted a different color that is easily distinguishable from silver, e.g., black or red. Such a feature may be used to indicate where to attach side rails (not shown) or other structure to frame 216. Further, markings, stickers, or other identification members may be used to further identify attachment positions for engagement of various different components to frame 216.

Figure 19:
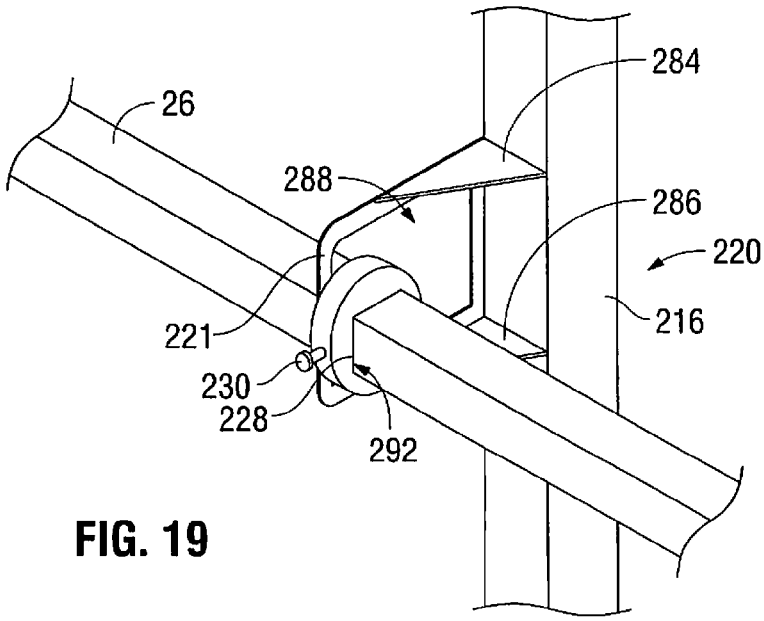
FIG. 19 is an enlarged, perspective view of a bracket member configured for use with the adjustable bed system of FIG. 15.

FIG. 19 shows another embodiment of a bracket member 220 secured to the frame 216. Bracket member 220 generally defines a rectangular-shaped plate 221 having first and second triangular-shaped wings 284, 286 extending outwardly therefrom for securely engaging bracket member 220 to frame 216, e.g., via welding. Bracket member 220 further includes a longitudinally-oriented opening 288 defined through plate 221 that is configured and dimensioned to allow the drive shaft 26 to pass therethrough.

With continued reference to FIG. 19, a ring member 228 is configured and dimensioned for positioning adjacent bracket member 220. Ring member 228 includes an opening 292 extending therethrough that is configured and dimensioned to receive the drive shaft 26 and a screw member 230 that can be brought into and out of engagement with the drive shaft 26 to fix the position of the drive shaft 26 relative to the ring member 228. Ring member 228 defines an outer dimension that is larger than the dimension of the opening 288 extending through plate 221 of bracket member 220 and is configured for positioning closer to transition box 222 (FIG. 15) relative to bracket member 220. This configuration helps retain drive shaft 26 in engagement with transition box 222 (FIG. 15), especially in embodiments where drive shaft 26 is spring-biased toward a more-extended position. In such an embodiment, the ring member 228 inhibits further extension of drive shaft 26 due to positioning of ring member 228 relative to bracket member 220, thus retaining drive shaft 26 in engagement with transition box 222 (FIG. 15). Further, wings 284, 286 inhibit substantial lateral movement of ring member 228 disposed therebetween, thus providing additional lateral support for drive shaft 26.

Referring to FIGS. 15-16, the assembly, use, and operation of bed system 200 will be briefly described to further point out the differences between bed system 10 and bed system 200. Similarly as described above with respect to bed system 10, bed system 200 may be configured for use with identical end boards, e.g., a pair of end boards 120 (FIG. 13), or with different end boards $\mathbf{14}_A$, $\mathbf{14}_B$. For brevity purposes, the assembly, use, and operation of bed system 200 will be described mainly with respect to end boards $\mathbf{14}_A$, $\mathbf{14}_B$, although the differences associated with the use of end boards 120 will be pointed out as well.

Initially, the end boards are positioned as illustrated in FIG. 15 such that the output assembly $\mathbf{112}_A$ of the height adjustment mechanism $\mathbf{104}_A$ included on the end board $\mathbf{14}_A$ faces the output assembly $\mathbf{112}_B$ (FIGS. 1, 2, 12) of the height adjustment mechanism $\mathbf{104}_B$ included on the end board $\mathbf{14}_B$. Thereafter, the frame 216 is secured to the end boards $\mathbf{14}_A$, $\mathbf{14}_B$, and the transmission rod 248 of the transition box 222 is connected to the output assembly $\mathbf{112}_A$. Either prior, or subsequent, to connection of the end boards $\mathbf{14}_A$, $\mathbf{14}_B$, the drive shaft 26 is connected to transition box 222 at one end thereof and directly to the output assembly $\mathbf{112}_B$ of end board $\mathbf{14}_B$ at the other end thereof.

More specifically, the drive shaft 26 is connected to one of first and second gears 250, 254, respectively, depending on the configuration of the end boards used. For example, where end boards $\mathbf{14}_A$, $\mathbf{14}_B$ are used, drive shaft 26 is connected to second gear 254 such that rotation of transmission rod 248 of transition box 222 effects opposite rotation of drive shaft 26. On the other hand, where end boards 120 are used, drive shaft is connected to first gear 250 such that rotation of transmission rod 248 effects rotation of drive shaft 26 is a similar direction.

Following connection of the drive shaft 26, hand crank 116 is coupled to height adjustment mechanism $\mathbf{104}_A$ of end boars $\mathbf{14}_A$ such that, upon rotation of the hand crank 116, the height of the end board $\mathbf{14}_A$ will be adjusted. More specifically, upon rotation of the hand crank 116 in a first direction, the height of the end board $\mathbf{14}_A$ will be increased. Concomitantly, with rotation of the hand crank 116, the transmission rod 248 of the transition box 222 is caused to rotate in a similar direction. Rotation of the transmission rod 248 effectuates corresponding rotation of first shaft 252 and first gear 250 which, in turn, causes rotation of second gear 254 in the opposite direction. Accordingly, with second gear 254 rotating in the opposite direction, drive shaft 26, which is coupled thereto, is similarly rotated in the opposite direction relative to transmission rod 248. The opposite rotation of transmission rod 248 and drive shaft 26 effects similar raising or lowering of end boards $\mathbf{14}_A$, $\mathbf{14}_B$ relative to frame 216, depending on the direction of rotation of hand crank 116.

On the other hand, as mentioned above, where end boards 120 are used, drive shaft 26 is connected to first gear 250 such that rotation of transmission rod 248 effects rotation of drive shaft 26 is a similar direction, thereby effecting similar raising or lowering of end boards 120 relative to frame 216, depending on the direction of rotation of hand crank 116.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. An adjustable bed system comprising:

first and second end boards each having an independent height adjustment mechanism therein;

a frame assembly configured and dimensioned to be secured to the first end board at a first end thereof and to the second end board at a second end thereof, the frame assembly including:

a frame; and a transition box secured to the frame at the first end thereof, the transition box operatively engagable with the height adjustment mechanism of the first end board; and a drive shaft adjustable between a first length and a second length, the drive shaft coupled at a first end thereof to the transition box and coupled at a second end thereof to the second end board, the drive shaft operable to facilitate uniform height adjustment of the first and second end boards, wherein the transition box includes a housing having first and second inputs at one end thereof, each input having a gear selectively couplable to the first end of the drive shaft, the gears disposed in meshed engagement with one another, the transition box further including a rod extending outwardly from the other end thereof, the rod coupled to the gear of the first input and engaged to the height adjustment mechanism of the first end board.

2. The bed system of claim 1, wherein the drive shaft includes a center portion, and a plurality of outer portions extending from the center portion, the center portion and the outer portions being connected in telescoping arrangement to facilitate selective adjustment of the drive shaft between the first and second lengths.

3. The bed system of claim 1, wherein the transition box includes markings on an outer periphery of the housing and adjacent to at least one of the first and second inputs to distinguish the first and second inputs from one another.

4. The bed system of claim 1, wherein the gears of the first and second inputs are disposed in vertical registration relative to one another.

5. The bed system of claim 1, wherein the first and second end boards are identical in structure.

6. The bed system of claim 5, wherein the drive shaft is coupled to the gear of the second input of the transition box such that the rod and the drive shaft are rotatable in opposite directions to effect uniform height adjustment of the first and second end boards.

7. The bed system of claim 1, wherein the first end board is different from the second end board.

8. The bed system of claim 7, wherein the drive shaft is coupled to the gear of the first input of the transition box such that the rod and the drive shaft are rotatable in similar directions to effect uniform height adjustment of the first and second end boards.

9. The bed system of claim 1, wherein the length of the drive shaft is adjusted to accommodate usage of various different end boards with the frame assembly.

10. The bed system of claim 1, wherein the length of the drive shaft is adjusted to accommodate engaging the drive shaft within a plurality of inputs of the transition box.

11. The bed system of claim 1, further comprising a bracket member engaged to the frame and extending from an underside thereof, the bracket member configured and dimensioned to receive the drive shaft at least partially therethrough to inhibit relative movement between the drive shaft and the frame.

12. The bed system of claim 1, wherein at least one component of the frame assembly is color-coded to identify an attachment position on the frame.

13. A frame assembly for use in an adjustable bed system including a first end board with a first height adjustment mechanism therein, and a second end board with a second height adjustment mechanism therein, the frame assembly comprising:

a frame;

a drive shaft extending along a length of the frame and coupled to the height adjustment mechanisms of the first and second end boards, the drive shaft operable to facilitate uniform height adjustment of the first and second end boards; and a bracket member engaged to the frame on an underside thereof, the bracket member including a first end with a first side opening defining an inner dimension, and a second end with a second side opening defining an inner dimension, the first and second side openings configured and dimensioned to receive the drive shaft therethrough and inhibit relative movement between the drive shaft and the frame.

14. The bed system of claim 13, wherein the frame assembly further includes a ring member including an opening extending therethrough configured and dimensioned to receive the drive shaft, the ring member defining an outer dimension larger than the inner dimensions of the first and second side openings of the bracket member, whereby the ring member is prevented from passing through the first and second side openings in the bracket member to further inhibit relative movement between the drive shaft and the frame.

15. The bed system of claim 14, wherein the ring member further includes a screw member that is repositionable relative to the ring member to vary the opening extending through the ring member, to thereby selectively inhibit relative movement between the drive shaft and the ring member.

16. The bed system of claim 13, wherein the bracket member includes a plate having a pair of wings extending therefrom for engaging the bracket member to the frame, the plate including an opening defined therethrough that is configured and dimensioned to permit passage of the drive shaft therethrough.

17. The bed system of claim 13, wherein the drive shaft defines an adjustable length, the drive shaft selectively adjustable between a first length and a second length for at least one of coupling to various different types of end boards and coupling to the first and second end boards in different positions.

18. The bed system of claim 13, wherein at least one component of the frame assembly is color-coded to identify an attachment position on the frame.

* * * * *